US005594427A

United States Patent [19]

Kim et al.

[11] Patent Number: 5,594,427

[45] Date of Patent: Jan. 14, 1997

[54] APPARATUS FOR AND METHOD OF REMOTE CONTROLLING OPERATION OF VIBRATION ROLLER

[75] Inventors: Jong P. Kim; Byung H. Kim, both of Kyungki-Do; Cheoul H. Ahn, Seoul; Tae H. Kim, Kyungki-Do; Do H. Choi, Seoul, all of Rep. of Korea

[73] Assignees: Korea Institute of Construction Technology; Korea Construction Financial Cooperative, both of Rep. of Korea

[21] Appl. No.: 359,893

[22] Filed: Dec. 20, 1994

[51] Int. Cl.[6] ..... H04Q 1/00

[52] U.S. Cl. ..... 340/825.72; 404/113; 404/117

[58] Field of Search ..... 404/113, 117; 340/825.69, 825.72

[56] References Cited

U.S. PATENT DOCUMENTS

| | | | |
|---|---|---|---|
| 3,906,369 | 9/1975 | Pitman et al. | 340/825.72 |
| 4,023,178 | 5/1977 | Suyama | 340/825.69 |
| 4,260,281 | 4/1981 | Sargent | 404/117 |
| 5,082,396 | 1/1992 | Polacek | 404/117 |
| 5,450,068 | 9/1995 | Steffen | 340/825.72 |

*Primary Examiner*—Brian Zimmerman
*Attorney, Agent, or Firm*—Spencer & Frank

[57] ABSTRACT

An apparatus for and a method of remote controlling an operation of a vibration roller, capable of achieving the operation of vibration roller under a condition that no operator have a ride in the vibration roller. The apparatus includes a wireless transmitting unit, a wireless receiving unit, a control unit for controlling functional parts required for the operation of vibration roller, an operation switch unit, a forward/rearward running manipulating unit, a steering unit and an acceleration and stop manipulating unit. The method includes the steps of analyzing operation command data, when the analyzed data is command data for ON/OFF of a particular switch of the operation switching unit, switching on or off the switch, when the analyzed data is data about an operation of the forward/rearward running manipulating unit, applying a drive voltage to the forward/rearward running manipulating unit for rotating a motor for a forward/rearward running lever, when the analyzed data is data about an operation of the steering unit, applying a drive voltage to the steering unit for rotating a motor for a steering handle shaft, and when the analyzed data is data about an operation of the acceleration and stop manipulating unit, applying a drive voltage to the acceleration and stop manipulating unit for rotating a motor for an acceleration knob and a stop knob.

15 Claims, 17 Drawing Sheets

FIG. 6B

| HEXADECINMAL CODE | | | | |
|---|---|---|---|---|
| DIGIT IN OUT | D7<br>D3 | D6<br>D2 | D5<br>D1 | D4<br>D0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| 0 | 1 | 0 | 1 | 0 |
| · | 1 | 0 | 1 | 1 |
| # | 1 | 1 | 0 | 0 |
| A | 1 | 1 | 0 | 1 |
| B | 1 | 1 | 1 | 0 |
| C | 1 | 1 | 1 | 1 |
| D | 0 | 0 | 0 | 0 |

APPARATUS FOR AND METHOD OF REMOTE CONTROLLING OPERATION OF VIBRATION ROLLER

BACKGROUND OF THE INVENTION

1. Field of the Invention

The present invention relates to an apparatus for and a method of remote controlling an operation of a vibration roller.

2. Description of the Prior Art

Generally, most of construction equipments involve a severe vibration in operation. Such a severe vibration of construction equipment is transferred to the body of an operator who manipulates the construction equipment. By such a transfer of vibration, the operator is suffered to a physical accident. In particular, various accidents may occur due to the generation of vibration. Moreover, operators tends to evade manipulating construction equipments, such as vibration roller, involving an impact caused by the vibration generated in operation. As a result, such construction equipments encounters a difficulty to keep the balance of a manpower supply and demand.

In order to solve the above-mentioned problems, construction equipments involving a severe impact are on an automatizing trend today. For example, there have been proposed an unmanned automatic system for a construction equipment in order to improve the performance of construction equipment and provide new functions of construction equipment. In other words, construction works are on an automatizing trend. Preferentially, schemes for automatizing manipulation of construction equipment are being made.

SUMMARY OF THE INVENTION

Therefore, an object of the invention is to solve the above-mentioned problems and, thus, to provide an apparatus for and a method of remote controlling an operation of a vibration roller under a condition that no operator have a ride in the vibration roller.

In accordance with one aspect, the present invention provides an apparatus for remote controlling an operation of a vibration roller, comprising: wireless transmitting means for generating data about operation control commands for the vibration roller by wireless; wireless receiving means for receiving the data from the wireless transmitting means by wireless; control means for receiving the operation control command data from the wireless receiving means and controlling functional units required for the operation of the vibration roller on the basis of the received data; operation switch means having a variety of switches each adapted to perform a switching operation thereof under a control of the control means; forward/rearward running manipulating means for enabling forward and rearward running operations of the vibration roller under a control of the control means; steering means for steering a steering handle of the vibration roller under a control of the control means; and acceleration and stop manipulating means for manipulating an acceleration knob and a stop knob both equipped in the vibration roller under a control of the control means.

In accordance with another aspect, the present invention provides a method of remote controlling an operation of a vibration roller including wireless transmitting and receiving means for receiving operation control commands from an operator and control means for controlling operations of operation switching means, forward/rearward running manipulating means, steering means and acceleration and stop means on the basis of the operation control commands, comprising the steps of: (A) executing an initialization in response to an application of an operating power and checking whether data about an operation control command from the operator has been inputted via the wireless receiving means; (B) when the operation control command data has been inputted, analyzing the inputted data; (C) when the operation command data has been analyzed at the step (B) as corresponding to command data for ON/OFF of-a particular switch of the operation switching means, switching on or off the particular switch; (D) when the operation command data has been analyzed at the step (B) as corresponding to data about an operation of the forward/rearward running manipulating means, applying a drive voltage to the forward/rearward running manipulating means for normally or reversely rotating a motor adapted to drive a forward/rearward running lever equipped in the forward/rearward running manipulating means; (E) when the operation command data has been analyzed at the step (B) as corresponding to data about an operation of the steering means, applying a drive voltage to the steering means for normally or reversely rotating a motor adapted to rotate a steering handle shaft equipped in the steering means; (F) when the operation command data has been analyzed at the step (B) as corresponding to data about an operation of the acceleration and stop manipulating means, applying a drive voltage to the acceleration and stop manipulating means for normally or reversely rotating a motor adapted to drive an acceleration knob and a stop knob both equipped in the acceleration and stop manipulating means.

BRIEF DESCRIPTION OF THE DRAWINGS

Other objects and aspects of the invention will become apparent from the following description of embodiments with reference to the accompanying drawings in which:

FIG. 6B is a table illustrating hexadecimal code data inputs and outputs of a dual-tone multifrequency decoding circuit shown in FIG. 5;

DETAILED DESCRIPTION OF THE PREFERRED EMBODIMENTS

Figure 1:
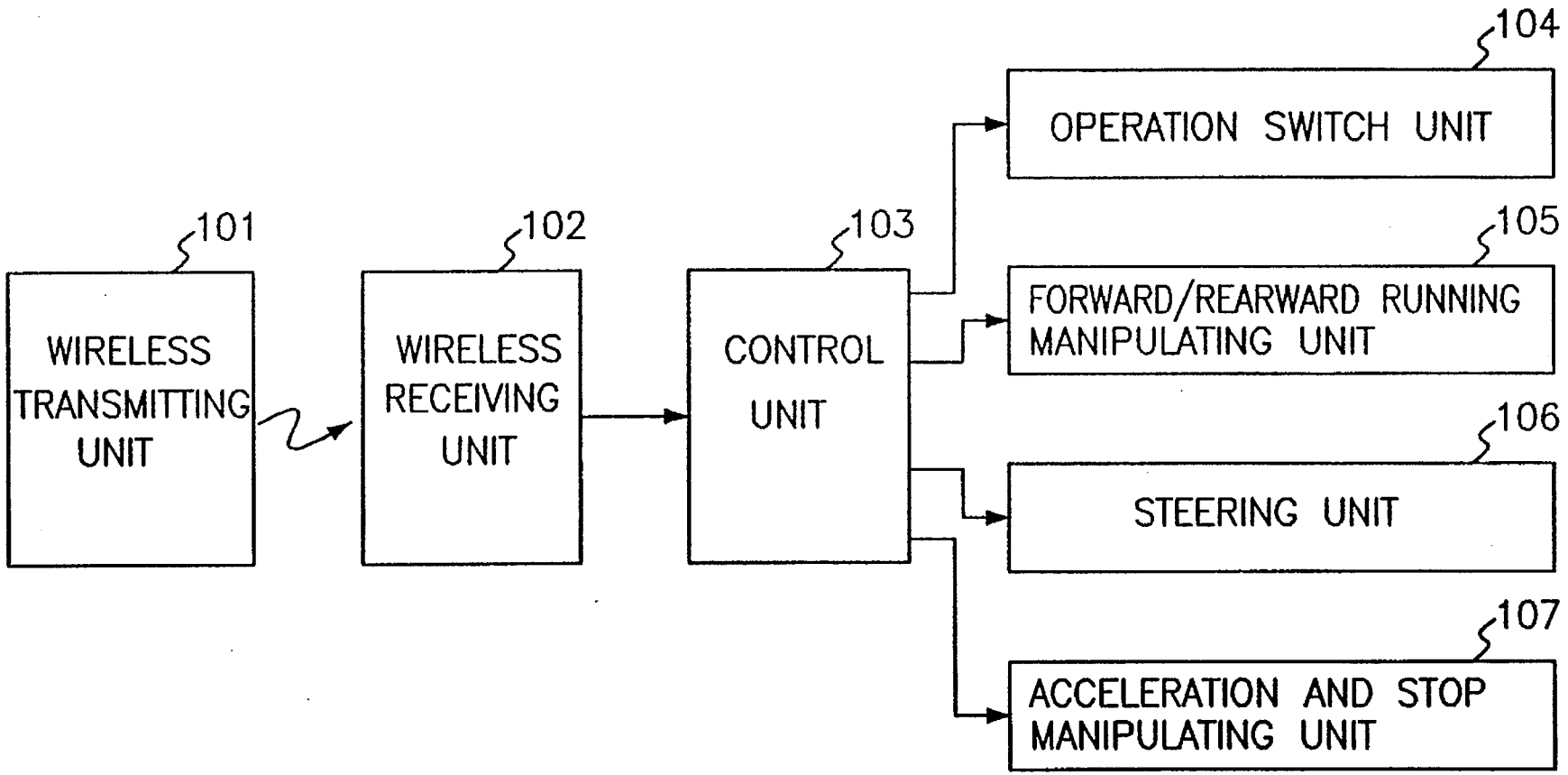
FIG. 1 is a block diagram of the overall arrangement of an apparatus for remote controlling an operation of a vibration roller in accordance with the present invention.

FIG. 1 is a block diagram of the overall arrangement of an apparatus for remote controlling an operation of a vibration roller in accordance with the present invention.

As shown in FIG. 1, the apparatus includes a wireless transmitting unit 101 for generating data about operation control command for the vibration roller by wireless, a wireless receiving unit 101 for receiving the data from the wireless transmitting unit 101 by wireless, and a control unit 103 for receiving the operation control command from the wireless receiving unit 102 and controlling functional units required for an operation of the vibration roller on the basis of the received operation control command. The apparatus also includes an operation switch unit 104 provided with a variety of switches each adapted to perform its switching operation under a control of the control unit 103, a forward/rearward running manipulating unit 105 for enabling the forward and rearward running of the vibration roller under a control of the control unit 103, a steering unit 106 for steering a handle of the vibration roller under a control of the control unit 103, and an acceleration and stop manipulating unit 107 for manipulating an acceleration knob and a stop knob both equipped in the vibration roller under a control of the control unit 103.

In order to achieve a remote control for the vibration roller, data about operation control for the vibration roller is generated by an operator, transmitted by the wireless transmitting unit 101, received by the wireless receiving unit 102, and then sent to the control unit 103 which controls the overall operation of the vibration roller. The transmission and receipt of data is achieved by wireless, utilizing an infrared ray or a wireless frequency.

Although not shown, the control unit 103 includes a central processing unit (CPU), peripheral units, and a drive circuit for driving control signals. As control programs stored in the CPU are executed, various control signals generated on the basis of drive command data received from the wireless receiving unit 102 are applied to the operation switch unit 104, the forward/rearward running manipulating unit 105, the steering unit 106 and the acceleration and stop manipulating unit 107.

The operation switch unit 104 includes an amplitude selector switch adapted to select the amplitude of vibration of the vibration roller, a speed selector switch adapted to select a running speed of the vibration roller, a power switch adapted to supply a drive power, a starter button switch adapted to initiate the operation of the vibration roller, and a vibration ON/OFF switch adapted to switch on and off the generation of vibration from the vibration roller. Each of the switches is controlled to be switched on and off under the control of the control unit 103.

The forward/rearward running manipulating unit 105 is a drive unit for manipulating a forward/rearward running lever and thereby controlling the running speed of the vibration roller in forward and rearward directions. For achieving an automatic manipulation of the forward/rearward running lever under a control of the control unit 103, the forward/rearward running manipulating unit 105 includes a motor for driving the forward/rearward running lever in accordance with a control signal generated from the control unit 103. This will be described in detail hereinafter. The lever can be also manually manipulated by the operator.

The steering unit 106 is a drive unit for steering the handle and thereby adjusting the running direction of the vibration roller. For achieving an automatic manipulation of the handle under a control of the control unit 103, the steering unit 106 includes a motor for driving the handle in accordance with a control signal generated from the control unit 103. This will be described in detail hereinafter. Of course, the handle can be manually manipulated by the operator.

The acceleration and stop manipulating unit 107 is a drive unit for driving the acceleration knob and the stop knob. In order to achieve an automatic manipulation of the acceleration knob and the stop knob under a control of the control unit 103, the acceleration and stop manipulating unit 107 includes brackets fixedly mounted to the acceleration knob and the stop knob, respectively, mechanisms adapted to move the brackets, respectively, and a motor adapted to drive the mechanisms, respectively. This will be described in detail hereinafter. Of course, the knobs can be manually manipulated by the operator.

Figure 2:
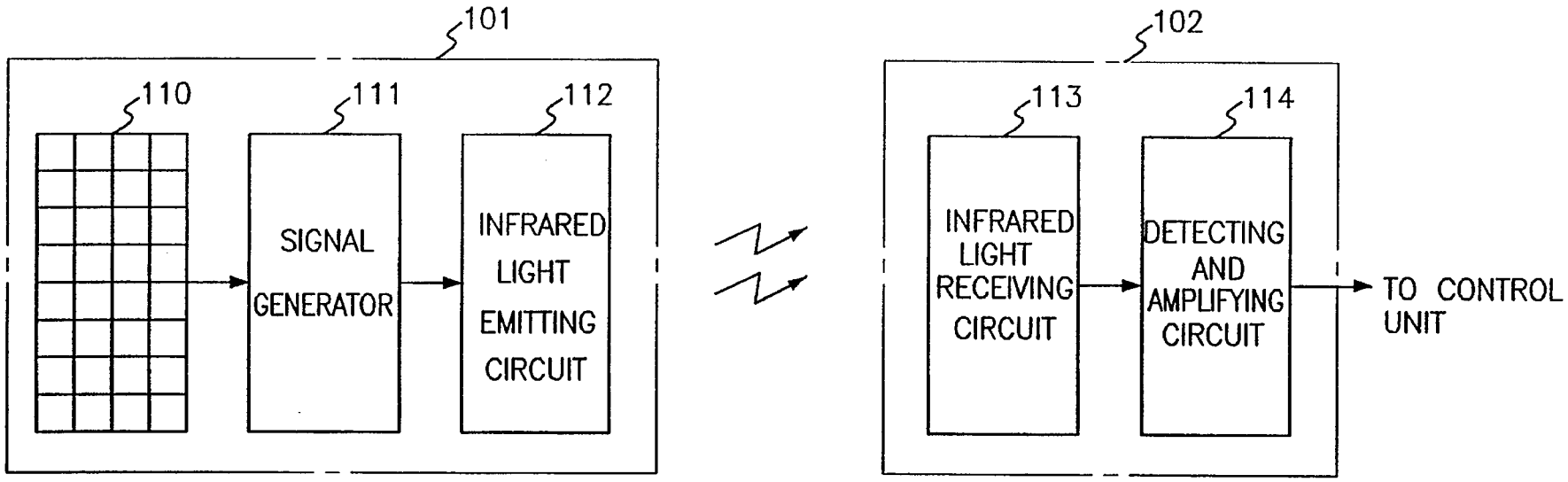
FIG. 2 is a block diagram illustrating detailed arrangements of wireless transmitting and receiving units shown in FIG. 1 in accordance with an embodiment of the present invention.

FIG. 2 is a block diagram illustrating detailed arrangements of the wireless transmitting and receiving units 101 and 102 shown in FIG. 1 in accordance with an embodiment of the present invention. In accordance with this embodiment, the wireless transmitting and receiving units are adapted to transmit and receive command data from the operator for operation of the vibration roller by utilizing pulses of infrared ray light. That is, the wireless transmitting unit 101 includes a key pad 110 functioning as a user command data interface, a signal generator 111 for generating a signal frequency corresponding a key input from the key pad 110, and an infrared light emitting circuit 112 for converting the output from the signal generator 111 into an infrared light pulse and outputting the infrared light pulse as serial data. On the other hand, the wireless receiving unit 102 includes an infrared light receiving circuit 113 for receiving the light pulse from the infrared light emitting circuit 112 and converting the received light pulse into an electrical signal, and a detecting and amplifying circuit 114 for detecting and amplifying an output signal from the infrared light receiving circuit 113, shaping the amplified signal, and then sending the resultant signal to the control unit 103.

The key pad 110 includes a plurality of key switches each adapted to be manipulated by the operator. The signal generator 111 outputs pulse data in series in response to key switching operations of the key pad 110. The circuit construction of the signal generator 11 having the above function is well known in the technical field. Accordingly, any further description relating to the signal generator 11 is made no longer.

Figure 3:
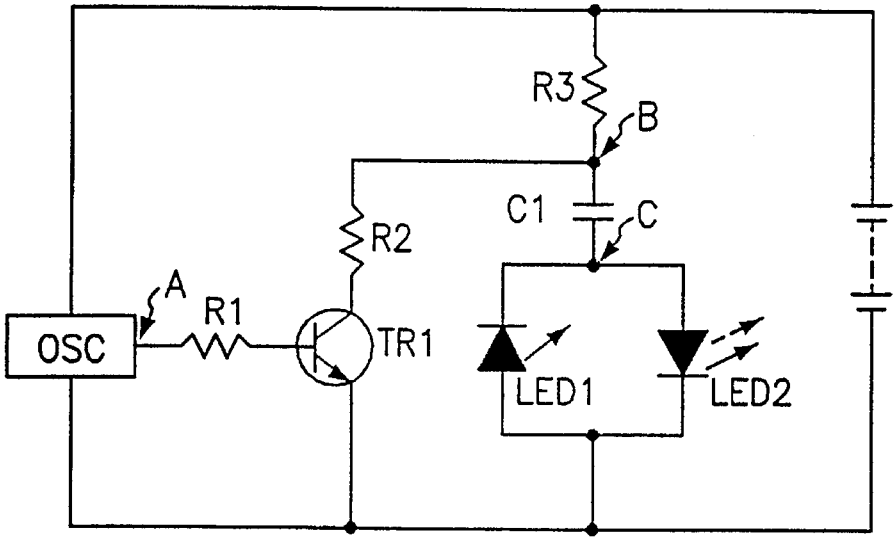
FIG. 3 is a circuit diagram of an infrared light emitting circuit of the wireless transmitting unit shown in FIG. 2.

Referring to FIG. 3, there is illustrated a construction of the infrared light emitting circuit 112. As shown in FIG. 3, the infrared light emitting circuit 112 includes a near infrared light emitting diode LED1 and a red color light emitting diode LED2 both coupled to a DC power source. The diodes LED1 and LED2 are connected to each other in reverse parallel. The infrared light emitting circuit 112 also includes a transistor TR1 having a base coupled to an oscillator OSC via a resistor R1. The transistor TR1 is also coupled at its collector to a junction C between the diodes LED1 and LED2 via a resistor R2 and a capacitor C1. To a junction B between the resistor R2 and the capacitor C1, a resistor R3 is coupled. In FIG. 3, the reference character A denotes a junction between the oscillator OSC and the resistor R1.

Now, operation of the infrared light emitting circuit 112 having the above-mentioned construction will be described.

At an OFF state of the transistor TR1, a drive current from the power source is charged in the capacitor C1 via the resistor R3 and the red color light emitting diode LED2. By the charged current, the diode LED2 emits light. When the transistor TR1 is switched to its ON state, the charge in the capacitor C1 is pulse discharged via the resistor R2, the transistor TR1 and the near infrared light emitting diode LED1. By this discharge, the diode LED1 emits light. The amount of current supplied to the diode LED1 is limited to a predetermined level by the resistor R2. Since most of the current amount flowing through the diode LED1 is derived from the charge in the capacitor C1, the average current amount supplied from the power source is approximate to the current amount charged in the capacitor C1. Accordingly, the current capacity of the power source balances with the charged current of the capacitor C1. Even when the transistor TR1 maintains its ON state or its OFF state due to a failure thereof or a failure of the signal generator 11, the light emitting diodes LED1 and LED2 are not damaged because no current flows through the diodes. When no pulse current flows through the diode LED1 due to a failure, there is no flow of charged current because the capacitor C1 does not discharge. In this case, accordingly, the diode LED2 also does not emit any light. Thus, the diode LED2 serves to indicate the operation of the diode LED1.

As apparent from the above description, the infrared light emitting circuit 112 can be driven by a small power capacity. The light emitting diodes are not damaged due to the failure of the signal generator 111 and the failure of the drive transistor. Since the red color light diode is connected to the near infrared light emitting diode in reverse parallel, it is possible to visibly check the operation condition of the near infrared light emitting diode through the red color light emitting diode.

Figure 4:
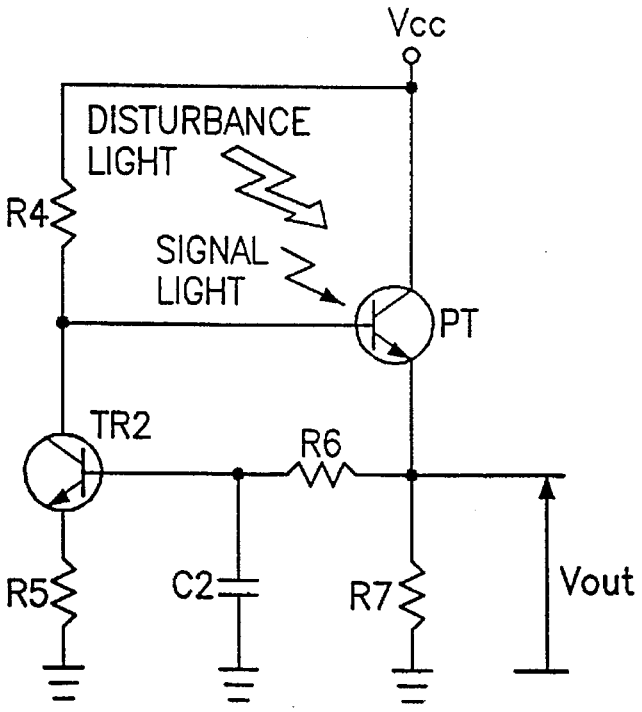
FIG. 4 is a circuit diagram of an infrared light receiving circuit of the wireless receiving unit shown in FIG. 2.

Referring to FIG. 4, there is illustrated a construction of the infrared light receiving circuit 113.

In infrared light receiving circuits, generally, an affect by disturbance light, such as sun light and illumination light, stronger than signal light becomes an issue. In order to avoid an adverse effect of the disturbance light, a pulse tube may be used. In this case, a frequency higher than a variable frequency of the disturbance light is used as an interrupt frequency of the signal light. Even in an infrared light receiving circuit including a photo transistor widely used as a light receiving element, the affect of the disturbance light becomes an issue.

The infrared light receiving circuit 113 shown in FIG. 4 is constructed to minimize an erroneous operation thereof caused by the affect of the disturbance light. As shown in FIG. 4, the infrared light receiving circuit 113 includes a photo transistor PT coupled at its collector to a voltage source Vcc and coupled at its emitter to the ground via a resistor R7, and a transistor TR2 coupled at its emitter to the ground via a resistor R5 and coupled at its base to the emitter of the photo transistor PT via a resistor R6. Between the resistor R6 and the transistor TR2, a grounded capacitor C2 is coupled. The photo transistor PT is also connected at its base to the voltage source Vcc via a resistor R4. The transistor TR2 is coupled at its collector to the voltage source Vcc via a resistor R4.

Now, operation of the infrared light receiving circuit 113 will be described.

Under a condition that there is no disturbance light, a signal light (modulated light) incident on the photo transistor PT is converted into an electrical signal which is, in turn, outputted from the photo transistor PT. A part of the electrical signal is applied to the integrating circuit constituted by the resistor R6 and the capacitor C2. By the integrating circuit, the electrical signal is integrated, so that it has only its DC component. The electrical signal is also applied to the base of the transistor TR2, thereby causing the transistor TR2 to be turned on. Accordingly, the voltage from the voltage source Vcc is applied to the base of the photo transistor PT while being divided by the resistors R4 and R5. By the voltage division, a voltage for driving the photo transistor PT is determined.

Where a disturbance light (DC light) is incident on the photo transistor PT, in addition to the signal light, the direct current flowing through the photo transistor PT tends to increase. However, this current decreases the impedance established by the integrating circuit while being applied to the transistor TR2 via the integrating circuit. Accordingly, the potential at the base state of the photo transistor PT is lowered, thereby causing the current flowing through the photo transistor PT to be limited to a certain level. That is, the photo transistor PT operates in a constant current range irrespective of the presence of the DC light. The photo transistor PT causes neither of any sensitivity reduction or any noise with respect to the modulated light. Even though only the signal light is incident on the photo transistor PT, the current flowing through the photo transistor PT may be likely to increase when the signal light has an increased intensity. Even in this case, the photo transistor PT is self-biased because the impedance of the transistor TR2 is lowered. Consequently, a stability in operation is improved.

Figure 5:
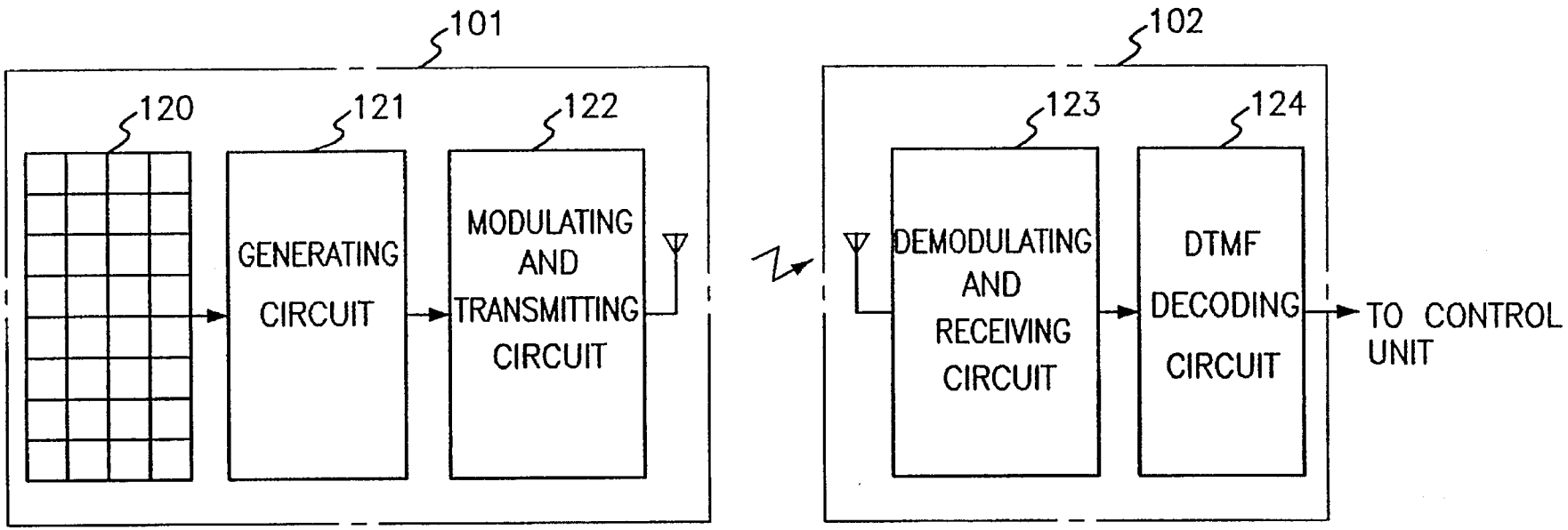
FIG. 5 is a block diagram illustrating detailed arrangements of wireless transmitting and receiving units shown in FIG. 1 in accordance with another embodiment of the present invention.

FIG. 5 is a block diagram illustrating detailed arrangements of the wireless transmitting and receiving units 101 and 102 shown in FIG. 1 in accordance with another embodiment of the present invention. In accordance with this embodiment, the wireless transmitting and receiving units are adapted to transmit and receive command data from the operator for operation of the vibration roller by utilizing a wireless frequency. That is, the wireless transmitting unit 101 includes a key pad 120 functioning as a user command data interface, a dual-tone multifrequency (DTMF) generating circuit 121 for generating a DTMF signal corresponding a key input from the key pad 120, and a modulating and transmitting circuit 122 for modulating an output signal from the DTMF generating circuit 121 and outputting the resultant signal. On the other hand, the wireless receiving unit 102 includes a demodulating and receiving circuit 123 for receiving the modulated signal from the modulating and transmitting circuit 122 and amplifying the resultant signal, and a DTMF decoding circuit 124 for decoding the DTMF signal outputted from the demodulating and receiving circuit 123 and sending the resultant signal in the form of hexadecimal code data to the control unit 103.

Figure 6A:
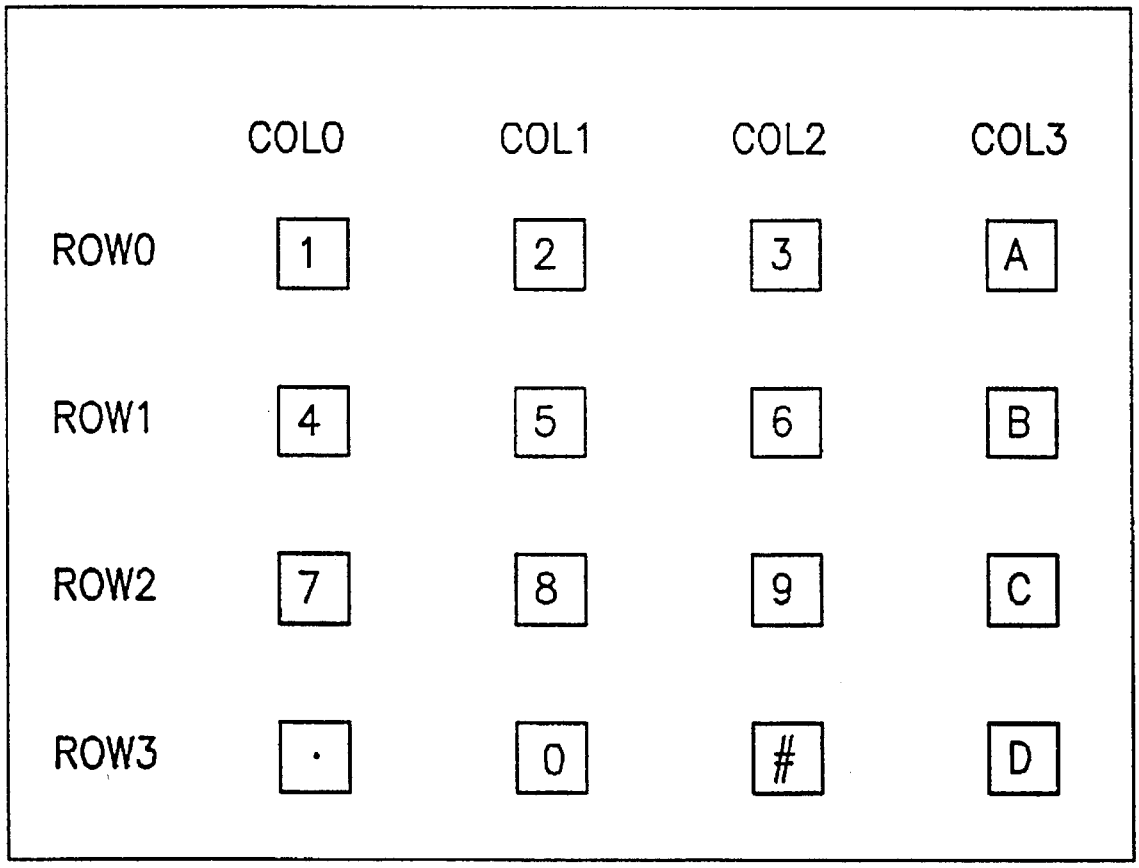
FIG. 6A is a schematic view illustrating a key matrix of a key pad shown in FIG. 5.

The key pad 120 has a DTMF dialing matrix so as to generate DTMF signals. The DTMF generating circuit 121 and the DTMF decoding circuit 124 for transmission and receipt of DTMF signals are constructed using well-known DTMF tranciver ICs such as SSI 75T2090. FIG. 6A shows a key matrix of the key pad 120 whereas FIG. 6B shows hexadecimal code data inputs and outputs of the DTMF decoding circuit 124.

On the other hand, the modulating and transmitting circuit 122 and the demodulating and receiving circuit 123 are constructed using modulating and demodulating circuits utilizing a frequency shift keying (FSK) system which is the digital modulation system. Constructions of these circuits are well known in the technical field and any further description thereof, therefore, is made no longer.

Figure 7A:
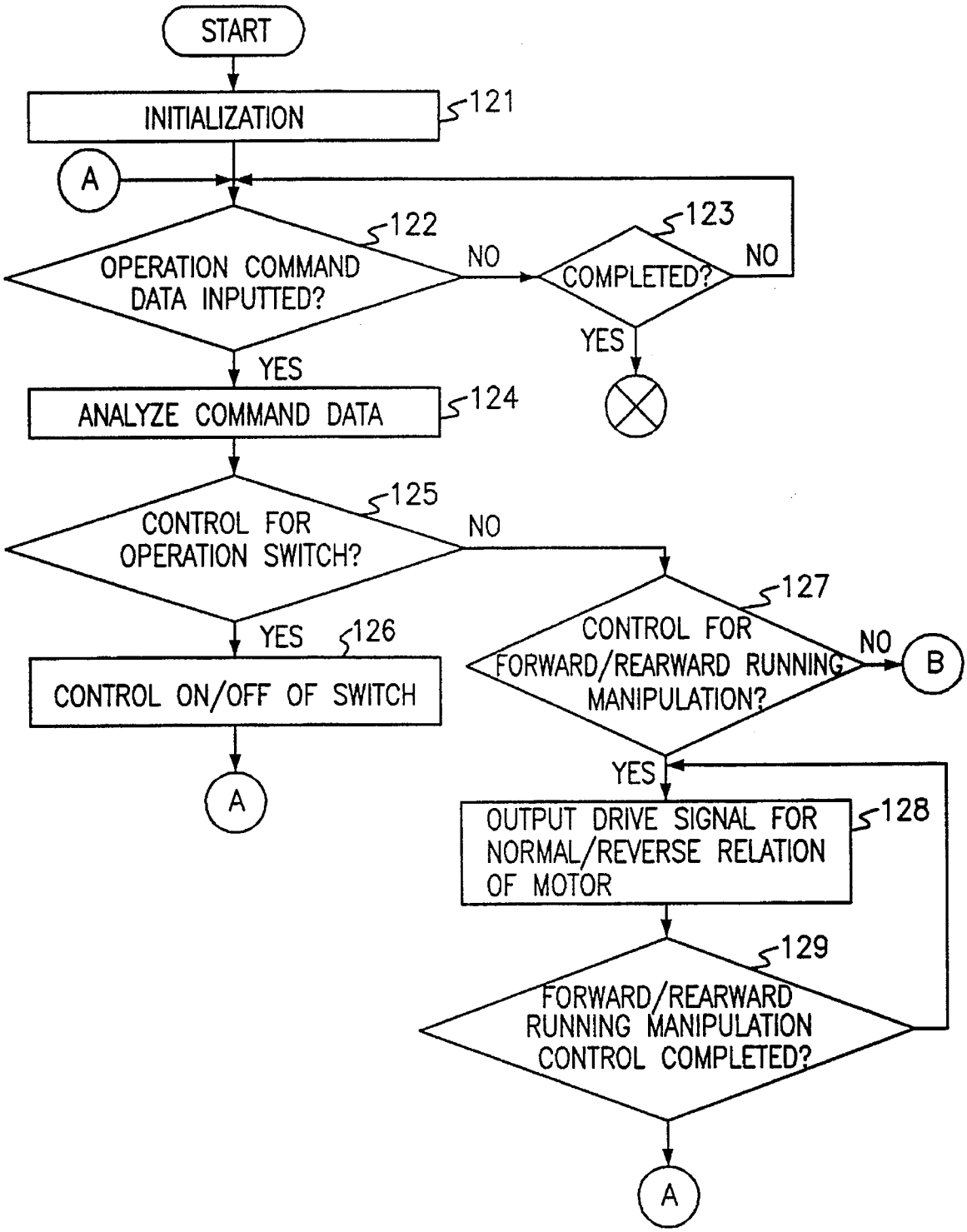
FIGS. 7A and 7B are flow charts respectively illustrating a method of controlling an operation of the vibration roller in accordance with the present invention.
Figure 7B:
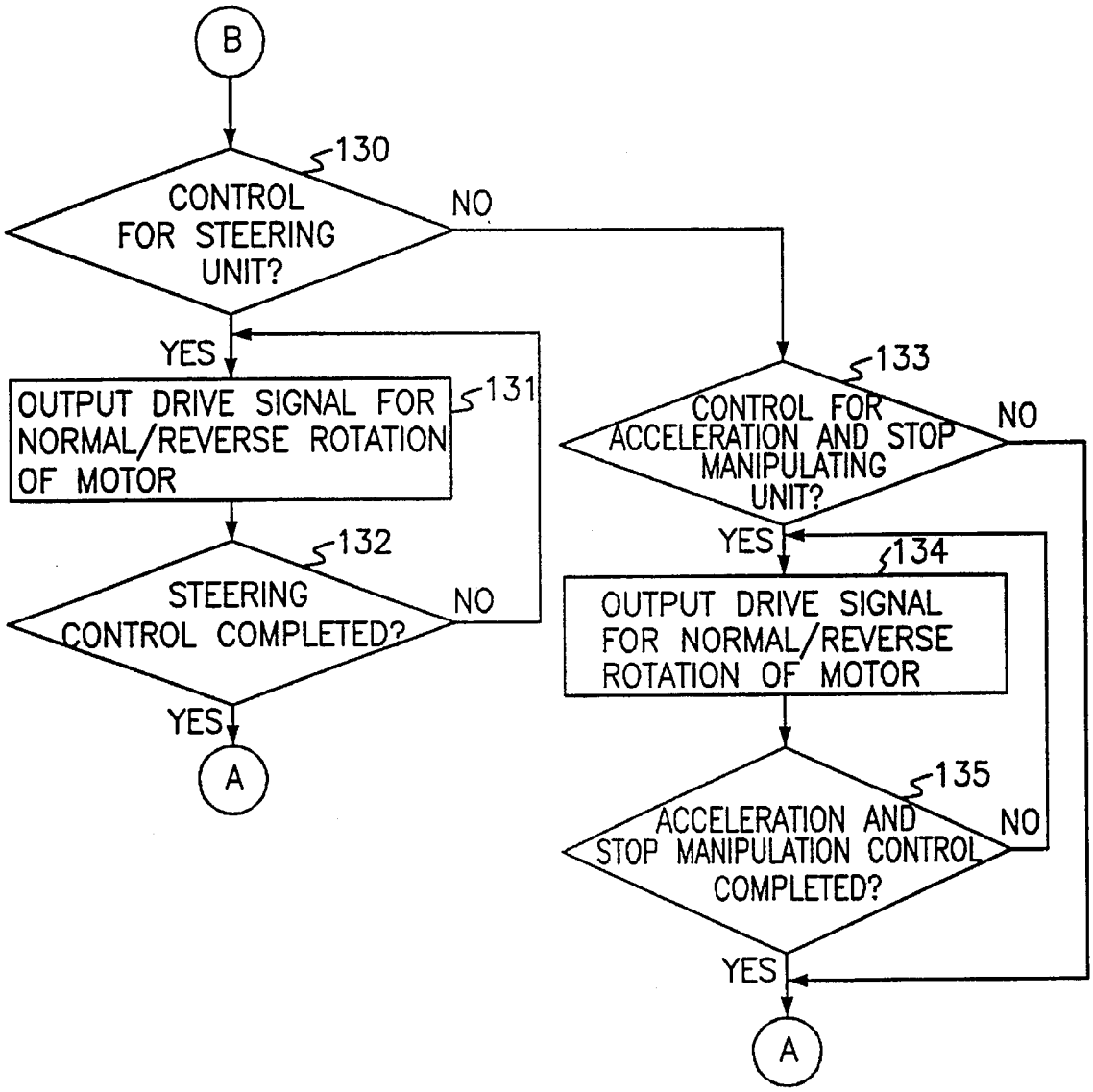

FIGS. 7A and 7B are flow charts respectively illustrating a method of controlling an operation of the vibration roller in accordance with the present invention. In particular, FIGS. 7A and 7B show the sequential steps of the program executed by the CPU of the control unit 103.

The control method in accordance with the present invention will now be described in detail in conjunction with FIGS. 7A and 7B. Once the power switch attached to a battery box of the vibration roller is switched on, the control unit 103 initializes a memory such as a random access memory (RAM), the wireless transmitting and receiving units 101 and 102 and various switches of the operation switch unit 104 (Step 121). Thereafter, a check is made about whether an operation command of the operator has been received in the wireless receiving unit 102 (Step 122). Where the operation command has been received in the wireless receiving unit 102, the control unit 103 analyzes the received operation command (Step 124).

Where the analyzed operation command data corresponds to command data for ON/OFF of a particular switch of the operation switch unit 104 (Step 125), the control unit 103 controls the operation switch unit 104 to turn on/off the particular switch (Step 126). The control unit 103 then returns the program to the step 122 for checking whether another operation command of the operator has been received in the wireless receiving unit 102.

Where the analyzed operation command data corresponds to data about an operation of the forward/rearward running manipulating unit 105 (Step 127), a determination is made about whether the operation command corresponds to a control command for forward running operation or a control command for rearward running operation. On the basis of the result of the determination, the control unit 103 applies a drive voltage to the forward/rearward running manipulating unit 105 for normally or reversely rotating the motor for the forward/rearward running lever of the forward/rearward running manipulating unit 105 (Step 128).

Outputting of the drive voltage for the forward/rearward running manipulation is completed when command data about completion of the forward/rearward running control is received in the control unit 103 (Step 129). After receiving the command data about completion of the forward/rearward running control, the control unit 103 returns the program to the step for checking whether another operation command of the operator has been received in the wireless receiving unit 102.

Where the analyzed operation command data corresponds to data about an operation of the steering unit 106 (Step 130), a determination is made about whether the operation command corresponds to a control command for left steering operation or a control command for right steering operation. On the basis of the result of the determination, the control unit 103 applies a drive voltage to the steering unit 106 for normally or reversely rotating the motor for a shaft of the handle of the steering unit 106 (Step 131). In similar to the drive voltage for the forward/rearward running manipulation, outputting of the drive voltage for the steering operation is completed when command data about completion of the steering control is received in the control unit 103 (Step 132). After receiving the command data about completion of the steering control, the control unit 103 returns the program to the step for checking whether another operation command of the operator has been received in the wireless receiving unit 102.

Where the analyzed operation command data corresponds to data about an operation of the acceleration and stop manipulating unit 107 (step 133), a determination is made about whether the operation command corresponds to a control command for acceleration or a control command for stop. On the basis of the result of the determination, the control unit 103 applies a drive voltage to the acceleration and stop manipulating unit 107 for normally or reversely rotating the motor for both the acceleration knob and the stop knob (Step 134).

Outputting of the drive voltage for the acceleration and stop operation is completed when command data about completion of the acceleration and stop control is received in the control unit 103 (Step 135). After receiving the command data about completion of the acceleration and stop control, the control unit 103 returns the program to the step for checking whether another operation command of the operator has been received in the wireless receiving unit 102.

On the other hand, where any operation command data has not been received at the standby state of the control unit 103 for receipt of operation command data, a determination is made whether a completion command has been received. When the completion command has been received, the control operation of the control unit 103 is completed.

As various functional units associated with the operation of the vibration roller are controlled in the above-mentioned manner in accordance with the present invention, the vibration roller can be remote controlled. Thus, an unmanned operation of the vibration roller is accomplished.

Now, detailed mechanical constructions and operations of the forward/rearward running manipulating unit 105, the steering unit 106 and the acceleration and stop manipulating unit 107 will be described.

First, the forward/rearward running manipulating unit 105 will be described in detail in conjunction with FIGS. 8 to 10.

Figure 8:
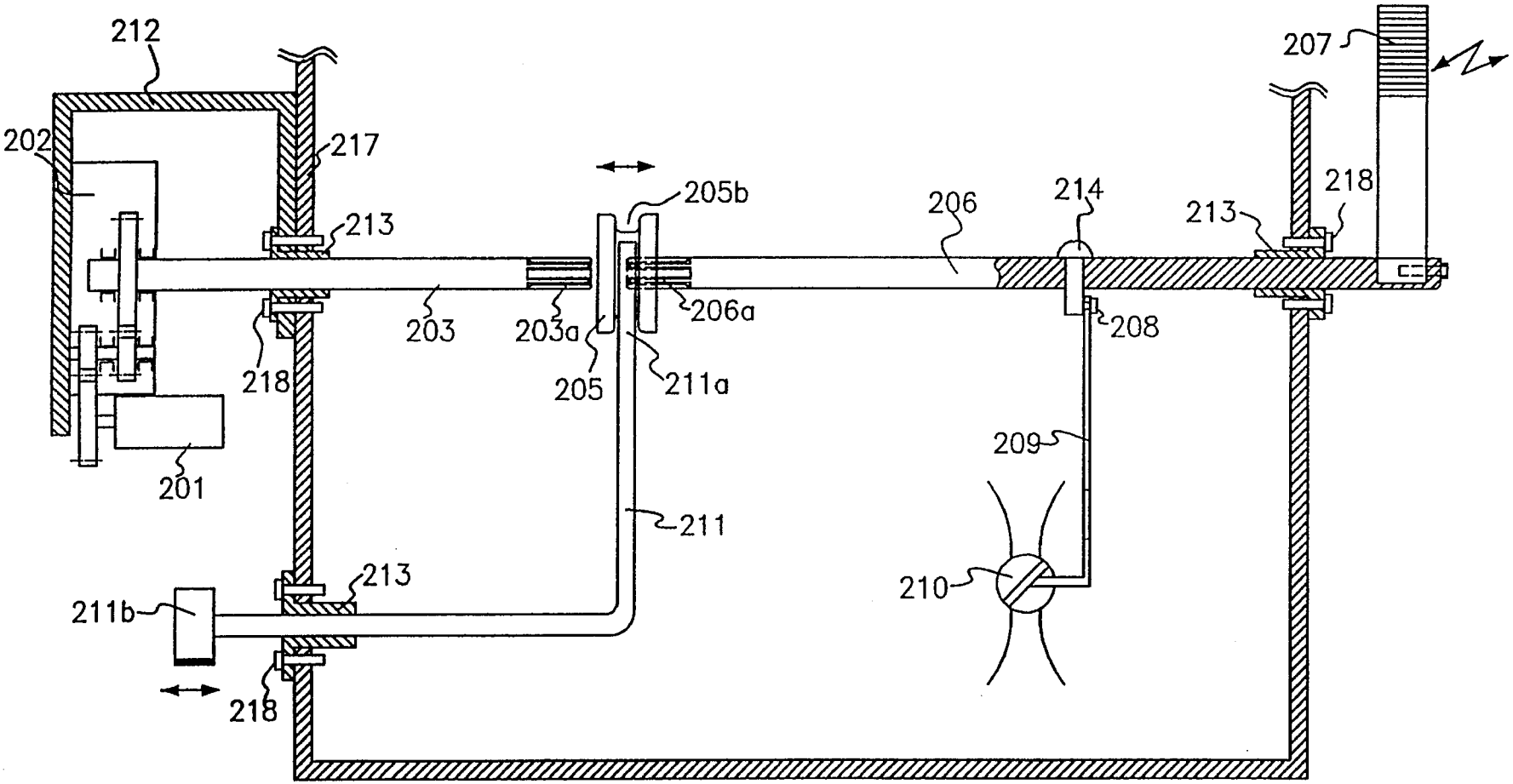
FIG. 8 is a partially-sectioned front view illustrating the overall construction of a first embodiment of a forward/rearward running manipulating unit shown in FIG. 1 in accordance with the present invention.

FIG. 8 is a partially-sectioned front view illustrating the overall construction of a first embodiment of the forward/rearward running manipulating unit 105. FIG. 9 is a side view illustrating a mounted condition of a clutch using a spline key. On the other hand, FIG. 10 is a partially-sectioned front view illustrating the overall construction of a second embodiment of the forward/rearward running manipulating unit 105.

Figure 9:
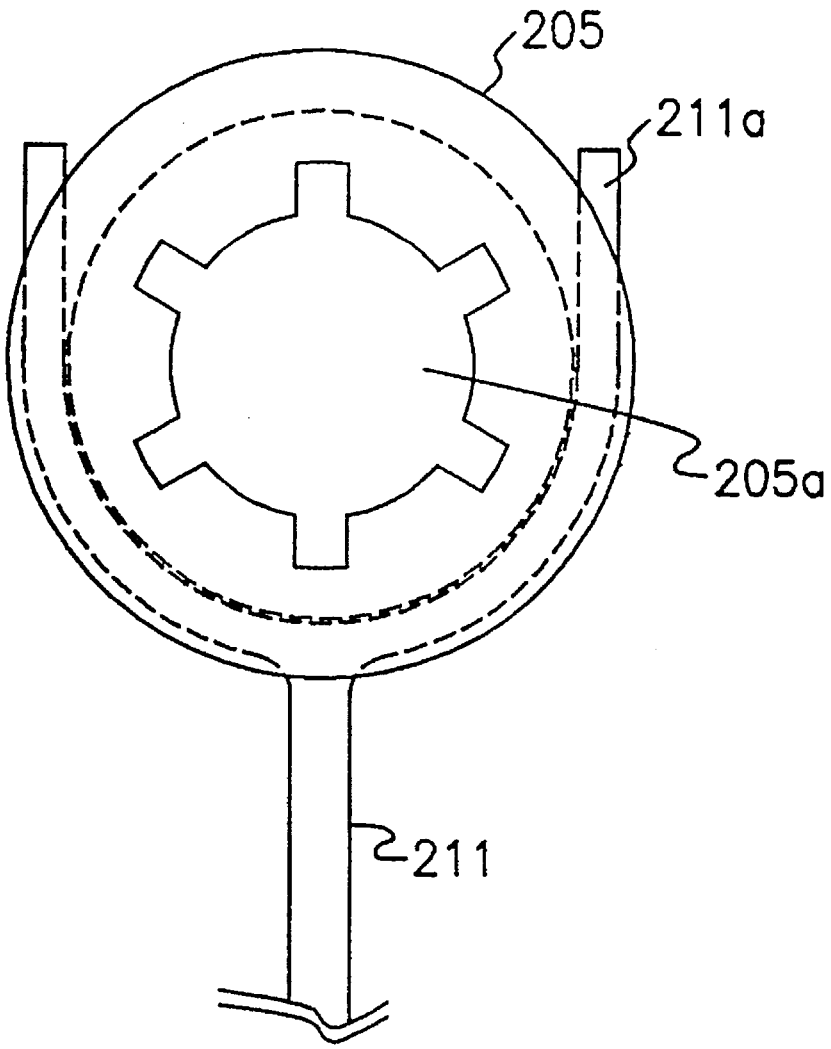
FIG. 9 is a side view illustrating a mounted condition of a clutch using a spline key in the case shown in FIG. 8.
Figure 10:
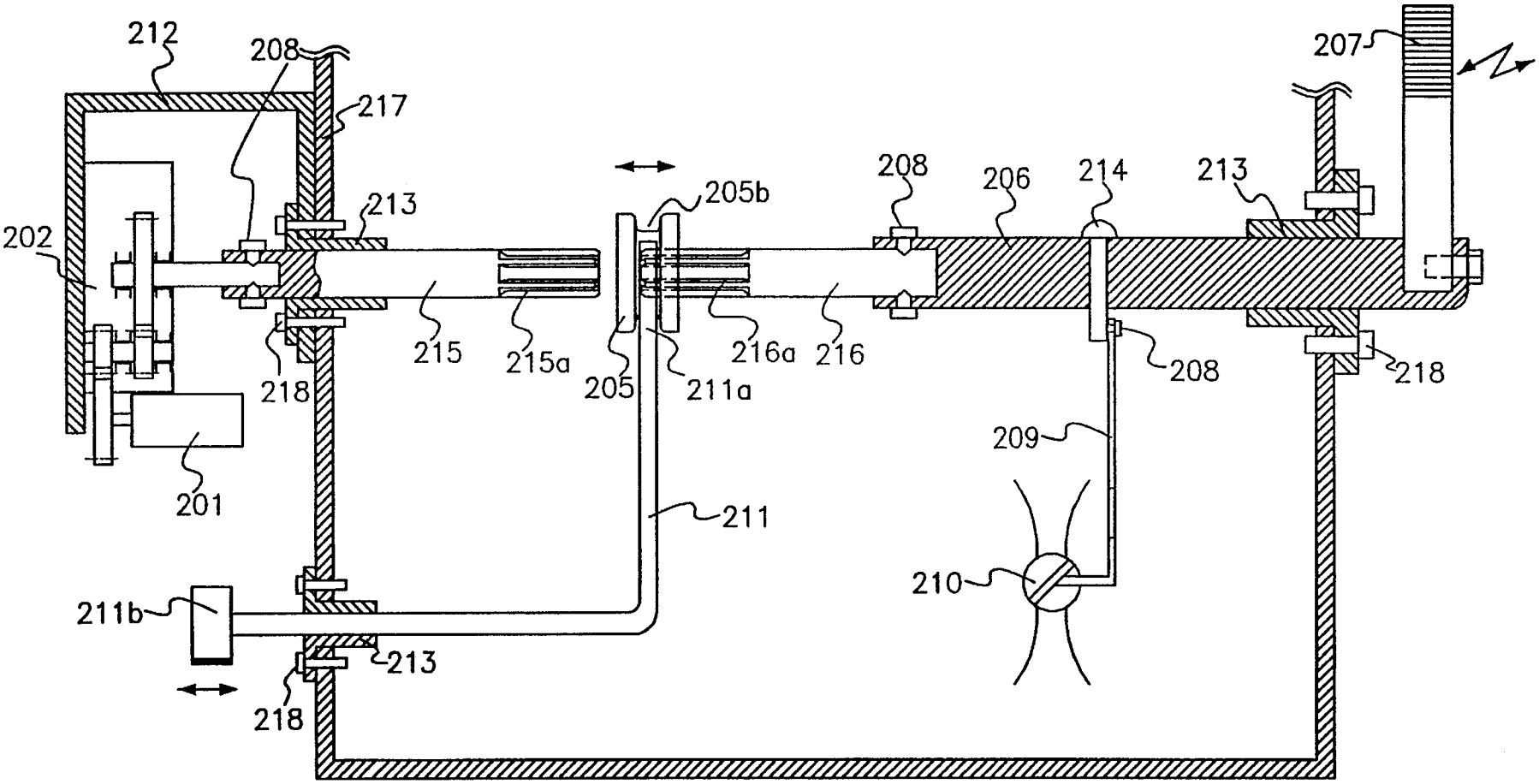
FIG. 10 is a partially-sectioned front view illustrating the overall construction of a second embodiment of the forward/rearward running manipulating unit in accordance with the present invention.

In FIGS. 8 to 10, the reference numeral 201 denotes a motor, 202 a gear box, 203, 215 and 216 spline shafts, 203*a*, 206*a*, 215*a* and 216*a* splines, 205 a spline key, 205*a* a spline key groove, 205*b* an annular groove 205*b*, 206 a lever shaft, 207 a lever, 208 a set screw, 209 a link, 210 an atomizer, 211 a clutch, 211*a* a connecting member, 211*b* a handle, 212 an assistant bracket, 213 sleeves, 214 a power transmitting pin, 217 a body bracket, and 218 fixing bolts.

The forward/rearward running manipulating unit 105 is constructed to adjust the displacement of the forward/rearward running lever on the basis of a control signal generated from the control unit 103 or generated by a manual manipulation of the operator.

In accordance with the first embodiment, the forward/rearward running manipulating unit 105 includes the motor 201 adapted to rotate normally and reversely upon receiving a drive voltage from the control unit 103. The motor 201 transmits its drive force to the gear box 202 via a motor gear mounted on a shaft of the motor 201 and engaged with an input gear of the gear box 202. The gear box 202 serves to reduce the rotation speed.

To the gear box 202, the spline shaft 203 is coupled at its one end. The spline shaft 203 is provided at its other end with the spline 203*a* selectively engaging with the spline key 205. The spline key 205 has at its central portion a spline key groove 205*a* adapted to engage with the spline 203*a* of spline shaft 203. The spline key 205 is provided at the middle portion of its peripheral edge with the annular groove 205*b* having a predetermined dimension.

The spline key 205 is a coupling having a clutch function for selectively coupling two shafts, one of which shafts is the spline shaft 203. The other shaft is the lever shaft 206 having at its one end a spline 206*a* engaging with the spline key groove 205*a* in opposite side of the spline shaft 203. The lever shaft 206 extends through a portion of the body bracket 217 equipped in the vibration roller so that it is supported by the body bracket 217. The body bracket 217 has a U shape. With such a construction, the drive force from the spline shaft 203 is selectively transmitted to the lever shaft 206 by the selective coupling between the shafts 203 and 206 obtained by the clutch action of the spline key 205.

The drive force transmitted to the lever shaft 206 is then transmitted to the lever 207 connected to the other end of the lever shaft 206, thereby causing the lever 207 to pivot forwards and rearwards about the lever shaft 206. The lever 207 extends from the other end of the lever shaft 206.

The power transmitting pin 214 is fitted in a pin hole perforated through an appropriate portion of the lever shaft 206 in perpendicular to the axis of the lever shaft 206. To a protruded end of the power transmitting pin 214, the link 209 is connected at its one end by means of the set screw 208. Connected to the other end of the link 209 is the atomizer 210 which is equipped in a diesel engine for the vibration roller. As the lever shaft 206 rotates normally or reversely by the drive force of motor 201 transmitted via the spline shaft 203 or by the pivotal movement of lever 207 caused by the manual manipulation of the operator, the link 209 moves upwards or downwards. By the vertical movement of link 209, the atomizer 210 is adjusted in opened degree to adjust the amount of an air introduced therein.

The introduced air is mixed with a fuel to form an air/fuel mixture. The air/fuel mixture is compressed and then ignited, so that the diesel engine produces a drive power for the vibration roller. The forward and rearward running speed of the vibration roller is determined depending on the amount of air introduced in the atomizer 210 adjusted by the pivotal displacement of the lever 207.

The forward/rearward running manipulating unit 105 also includes the clutch 211 which has an L shape. The clutch 211 is provided at its one end with the connecting member 211*a* having a U shape and at its other end with the clutch handle 211*b*. The connecting member 211*a* is engaged in the annular groove 205*b* of the spline key 205. As the clutch handle 211*b* is manually pushed or pulled, the clutch 211 forces the spline key 205 to slide laterally, thereby causing the spline shaft 203 to be coupled to or separated from the lever shaft 206. Thus, the drive force from the motor 201 is selectively transmitted to the lever shaft 206.

On the other hand, the gear box 202 is fixedly mounted to the inner surface of one wall of the assistant bracket 212 having a U shape. The assistant bracket 212 is fixedly mounted at its other wall to the body bracket 217. Sleeves 213 are mounted to perforated portions of the body bracket 217 respectively allowing the spline shaft 203, the clutch 211 and the lever shaft 206 to extend therethrough. The sleeves 213 are fixed by means of fixing bolts 218 and adapted to perform a bearing function for reducing the frictional resistance generated upon driving or moving the elements.

In accordance with the second embodiment shown in FIG. 10, the forward/rearward running manipulating unit 105 has a construction capable of more easily carrying out the assembling of elements thereof. For this construction, the forward/rearward running manipulating unit 105 includes the first spline shaft 215 coupled at its one end to the shaft of the gear box 202 and provided at its other end with the spline 215*a*, and the second spline shaft 216 coupled at its one end to the lever shaft 206 and provided at its other end with the spline 216*a*.

The coupling between the first spline shaft 215 and the shaft of gear box 202 and the coupling between the second spline shaft 216 and the lever shaft 206 are achieved using coupling of threads. In this case, the coupling of threads may be loosened when the spline shafts 215 and 216 rotate in a direction reverse to the direction that the threads are fastened. In order to prevent the loosening of coupled threads, the lever shaft 206 and the second spline shaft 216 have pin holes each extending in perpendicular to the axis of each corresponding shaft. In the pin holes, the set screws 208 are fitted, respectively.

Now, operations of the forward/rearward running manipulating unit 105 respectively carried out in response to the manual manipulation of the operator and in response to the control signal from the control unit 103 will be described in conjunction with FIG. 10.

First, the operation of the forward/rearward running manipulating unit 105 carried out in response to the manual manipulation of the operator will be descried. As the operator pushes or pulls to rotate the lever shaft 206 forwards or rearwards, the rotation force of the lever shaft 206 is transmitted to the link 209 via the power transmitting pin 214, thereby causing the link 209 to move upwards or downwards. By this vertical movement of the link 209, the atomizer 210 is opened or closed to suck or vent an air. By the opened degree of the atomizer 210, the forward/rearward running speed of the vibration roller is determined.

In this case, the first spline shaft 215 is maintained at its state that it is disengaged from the spline key 205 by the clutch 211.

The operation of the forward/rearward running manipulating unit 105 carried out in response to the control signal from the control unit 103 will now be described. For the remote controlled operation of the forward/rearward running manipulating unit 105, first, the operator pulls the clutch handle 211*b* of the clutch 211 so that the first spline shaft 215 engages with the spline key 205. When the control signal from the control unit 103 is received in the forward/rearward running manipulating unit 105 under this condition, the motor 201 is driven normally or reversely. Accordingly, the drive force of the motor 201 is transmitted to the gear box 202.

The gear box 202 receiving the drive force of the motor 201 carries out a reduction in rotation speed and then transmits the resultant rotation force to the lever shaft 206 via the first spline shaft 215, the spline key 205 and the second spline shaft 216. As the lever shaft 206 rotates by the rotation force transmitted thereto, the link 209 is vertically moved. At this time, the lever 207 is also pivotally moved.

The reason why the drive force from the motor 201 is transmitted even to the lever 207 is to check whether or not the remote control is well performed and to detect the position of the lever 207. When the lever 207 is positioned at its neutral position, a brake operation is carried out. Accordingly, the detection of the position of lever 207 is important.

As the link 209 is moved by the rotation of the lever 207, air is sucked into the atomizer 210, thereby enabling the vibration roller to run forwards or rearwards.

Now, the steering unit 106 will be described in detail in conjunction with FIGS. 11 and 12.

Figure 11:
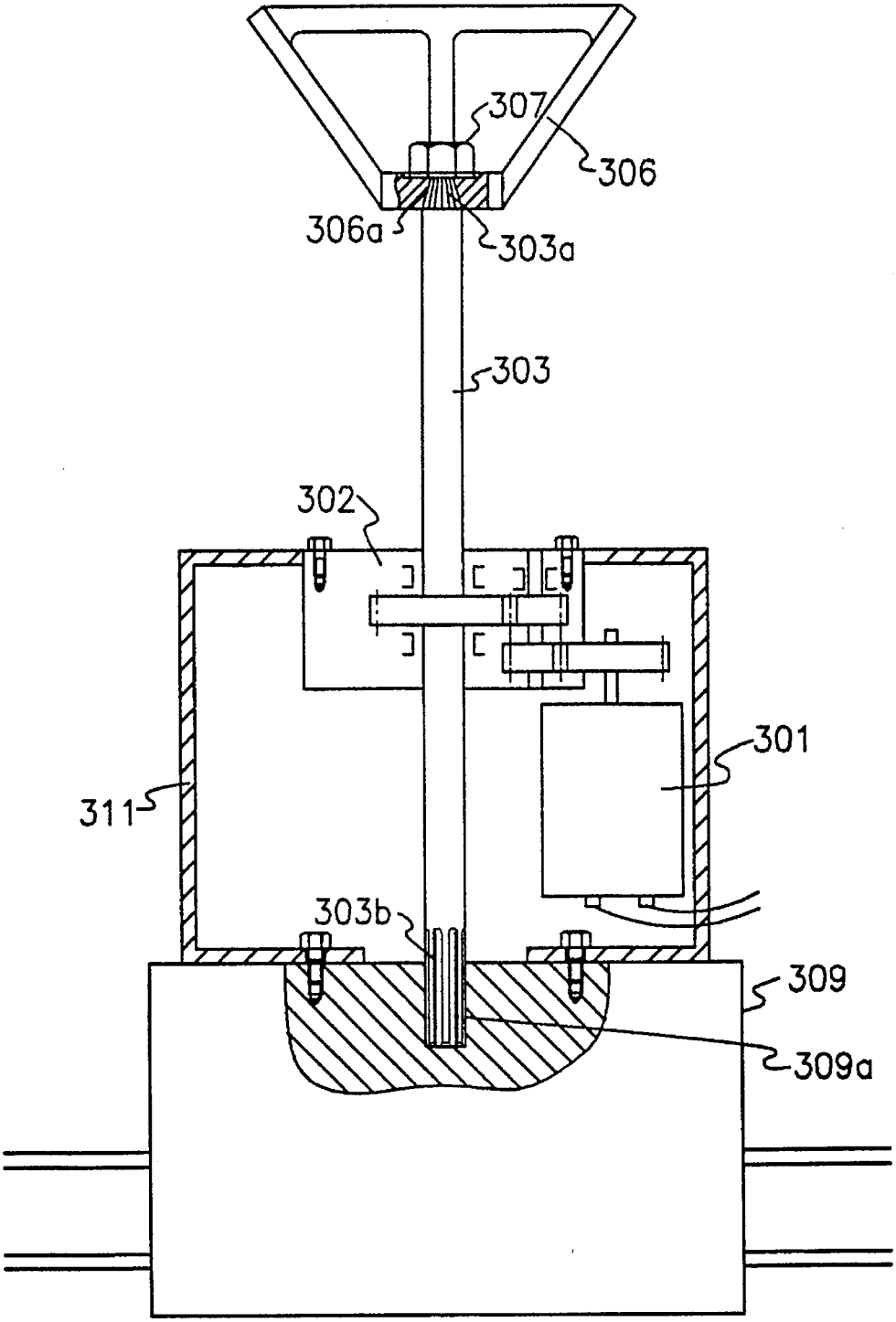
FIG. 11 is a partially-sectioned front view illustrating the overall construction of a first embodiment of a steering unit shown in FIG. 1 in accordance with the present invention.

FIG. 11 is a partially-sectioned front view illustrating the overall construction of a first embodiment of the steering unit 106. On the other hand, FIG. 12 is a partially-sectioned front view illustrating the overall construction of a second embodiment of the steering unit 106.

Figure 12:
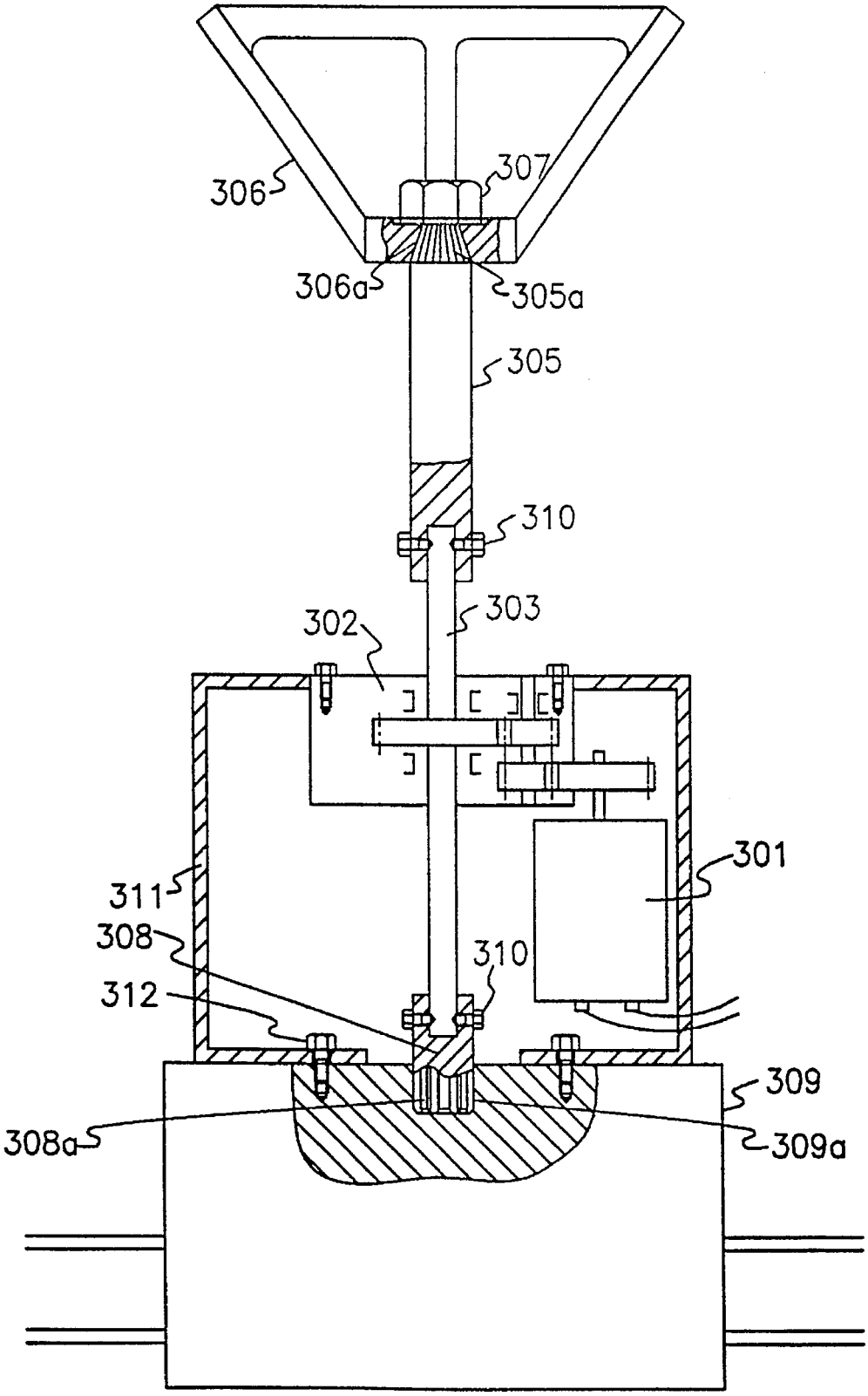
FIG. 12 is a partially-sectioned front view illustrating the overall construction of a second embodiment of the steering unit in accordance with the present invention.

In FIGS. 11 and 12, the reference numeral 301 denotes a motor, 302 a gear box, 303 a shaft, 303*a* and 305*a* serrations, 303*b* and 308*a* splines, 305 a serrated shaft, 306 a steering handle, 306*a* a key groove, 307 a fixing nut, 308 a spline shaft, 309 a hydraulic pump, 308 a spline groove, 310 set screws, 311 a steel bracket, and 312 bolts.

The steering unit 106 of the semi-automatic vibration roller is constructed to rotate left and right the steering handle in response to a control signal from the control unit 103 or in response to a manual manipulation of the operator and thereby to change the running direction of the vibration roller.

In accordance with the first embodiment shown in FIG. 11, the steering unit 106 includes the motor 301 adapted to rotate normally and reversely on the basis of the control signal from the control unit 103. The motor 301 transmits its drive force to the gear box 302 via a motor gear mounted on a shaft of the motor 301 and engaged with an input gear of the gear box 302. The gear box 302 has a plurality of gears for reducing the rotation speed.

Coupled to the gear box 302 is the shaft 303 which extends through the gear box 302. The shaft 303 has a predetermined length and serves to transmit the speed-reduced rotation force from the gear box 302 to various mechanical parts. The shaft 303 is provided at its upper end with the serration 303*a* engaging with the key groove 306*a* formed at the central portion of the steering handle 306. The upper end of the shaft 303 is coupled to the steering handle 306 by means of the fixing nut 307. The shaft 303 is also provided at its lower end with the spline 303*b* engaging with the spline groove 309*a* formed at the central portion of the hydraulic pump 309. With such a construction, both the steering handle 306 and the hydraulic pump are operatively connected to the motor 301 via the gear box 302 and the shaft 303 in an automatic operation mode based on the remote control.

In accordance with the second embodiment shown in FIG. 12, the steering unit 106 has a construction capable of more easily carrying out the assembling of elements thereof. For this construction, the steering unit 106 includes the serrated shaft 305 and the spline shaft 308 respectively coupled to the shaft 303. That is, the shaft 303 is indirectly coupled to both the steering handle 306 and the hydraulic pump 309. The serrated shaft 305 is provided at its lower end with a mounting hole for receiving the upper end of the shaft 303 extending through the gear box 302. The upper end of the shaft 303 fitted in the mounting hole of the serrated shaft 305 is fixed by means of the set screws 310. The serrated shaft 305 is also provided at its upper end with the serration 305*a* engaging with the key groove 306*a* formed at the central portion of the steering handle 306. The upper end of the serrated shaft 305 is coupled to the steering handle 306 by means of the fixing nut 307. Accordingly, the steering handle 306 is operatively connected to the motor 301 via the shaft 303 and the serrated shaft 305 in the automatic operation mode based on the remote control.

The spline shaft 308 is provided at its upper end with a mounting hole for receiving the lower end of the shaft 303. The lower end of the shaft 303 fitted in the mounting hole of the spline shaft 308 is fixed by means of the set screws 310. The spline shaft 308 is also provided at its lower end with the spline 308*a* engaging with the spline groove 309*a* formed at the central portion of the hydraulic pump 309. With such a construction, the hydraulic pump 309 is operatively connected to the motor 301 via the gear box 302, the shaft 303 and the spline shaft 308 in the automatic operation mode based on the remote control. Accordingly, a hydraulic motor (not shown) of the hydraulic pump 309 is driven by the drive force of the motor 301 to generate a hydraulic pressure which is, in turn, transmitted to wheels mounted on the axle of the vibration roller.

The coupling between the shaft 303 and the serrated shaft 305 and the coupling between the shaft 303 and the spline shaft 308 are achieved using coupling of threads. In this case, the coupling of threads may be loosened when the steering handle 306 rotate in a direction reverse to the direction that the threads are fastened. In order to prevent the loosening of coupled threads, the serrated shaft 305 and the spline shaft 308 have pin holes each extending in perpendicular to the axis of each corresponding shaft. In the pin holes, the set screws 310 are fitted, respectively.

Mounted on the hydraulic pump 309 is the steel bracket 311 having an appropriate shape and serving to fix the motor 301 and the gear box 302. The mounting of the steel bracket 311 to the hydraulic pump 309 is achieved using the bolts 312.

Now, operations of the steering unit 106 respectively carried out in response to the manual manipulation of the operator and in response to the control operation from the control unit 103 will be described in conjunction with FIG. 12.

First, the operation of the steering unit 106 carried out in response to the manual manipulation of the operator will be descried. As the operator rotates the steering handle 306, the rotation force of the steering handle 306 is transmitted to the hydraulic motor of the hydraulic pump 309 via the serrated shaft 305, the shaft 303 and the spline shaft 308, thereby causing the hydraulic motor to generate a hydraulic pressure. This hydraulic pressure is transmitted to the wheels on the axle of the vibration roller, thereby causing the vibration roller to be changed in direction.

In this case, the motor 301 is maintained at its OFF state. Since the gear box 302 can rotate freely at the OFF state of the motor 301, the operator can manipulate the steering handle 306 manually without requiring any large force.

The operation of the steering unit 106 carried out in response to the control signal from the control unit 103 will now be described. When the control signal for performing an automatic steering is received in the steering unit 106, the motor 301 is driven normally or reversely. Accordingly, the drive force of the motor 301 is transmitted to the gear box 302. The gear box 302 receiving the drive force of the motor 201 carries out a reduction in rotation speed and then transmits the resultant rotation force to the shaft 303.

As the shaft 303 rotates by the rotation force transmitted thereto, its rotation is transmitted to the steering handle 306 via the serrated shaft 305, thereby causing the steering handle 306 to rotate. Simultaneously, the rotation force of the shaft 303 is transmitted to the hydraulic pump 309 via the spline shaft 308. Accordingly, the hydraulic pump 309 applies a steering power to the wheels of the vibration roller.

The reason why the drive force from the motor 301 is transmitted even to the steering handle 306 is to recognize the rotated angle of the steering handle 306, as in the manual manipulation. Under the condition that the rotated angle of the steering handle 306 has been recognized, a manual return of the steering handle 306 to an original neutral position can be easily carried out. Accordingly, it is possible to prevent any erroneous steering manipulation.

Finally, the acceleration and stop manipulating unit 107 will be described in detail in conjunction with FIGS. 13 and 14.

Figure 13:
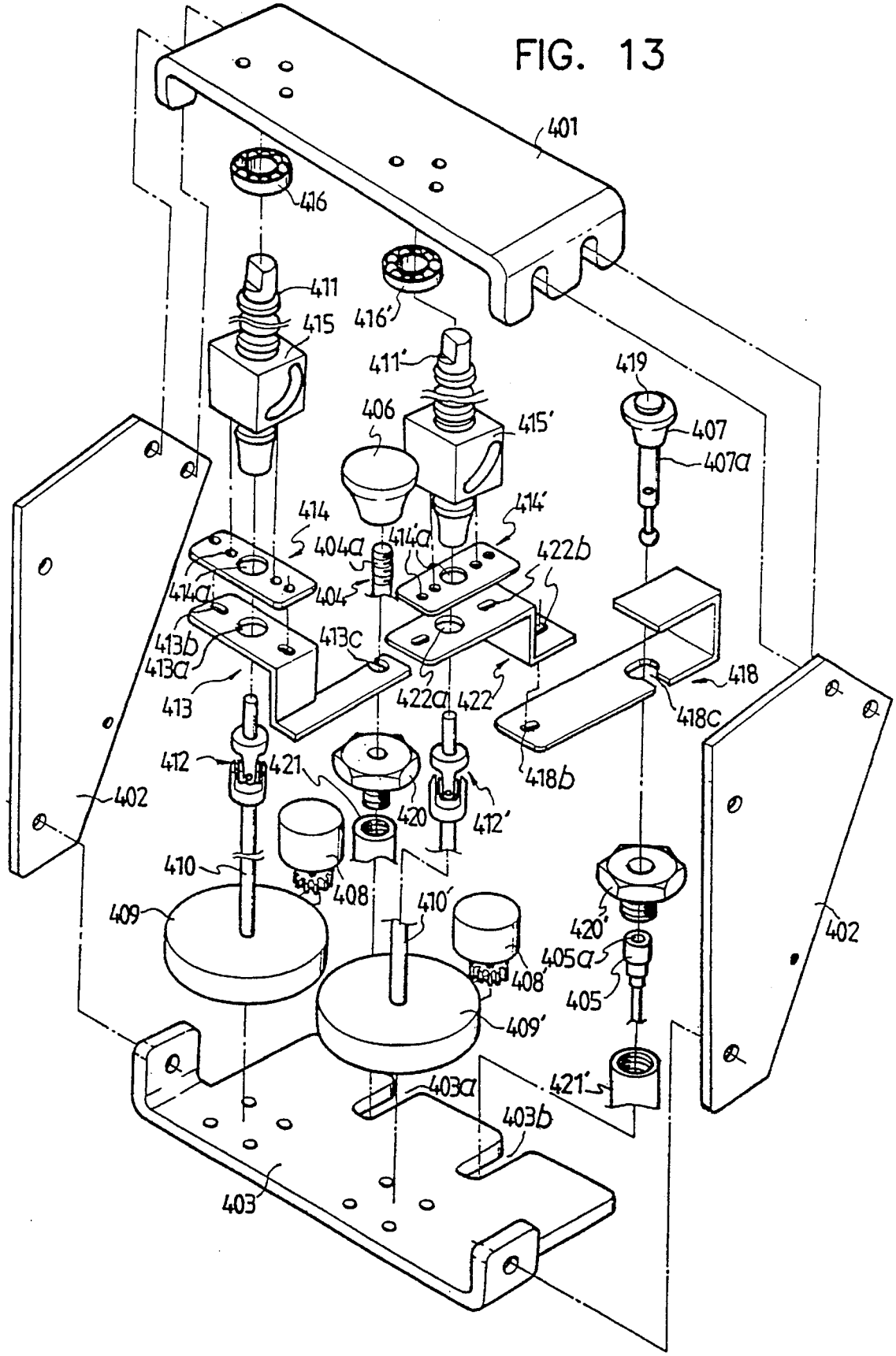
FIG. 13 is an exploded perspective view illustrating the overall construction of an embodiment of an acceleration and stop manipulating unit shown in FIG. 13 in accordance with the present invention.

FIG. 13 is an exploded perspective view illustrating the overall construction of an embodiment of the acceleration and stop manipulating unit 107. On the other hand, FIG. 14 is a partially-sectioned front view illustrating the acceleration and stop manipulating unit 107 shown in FIG. 13.

Figure 14:
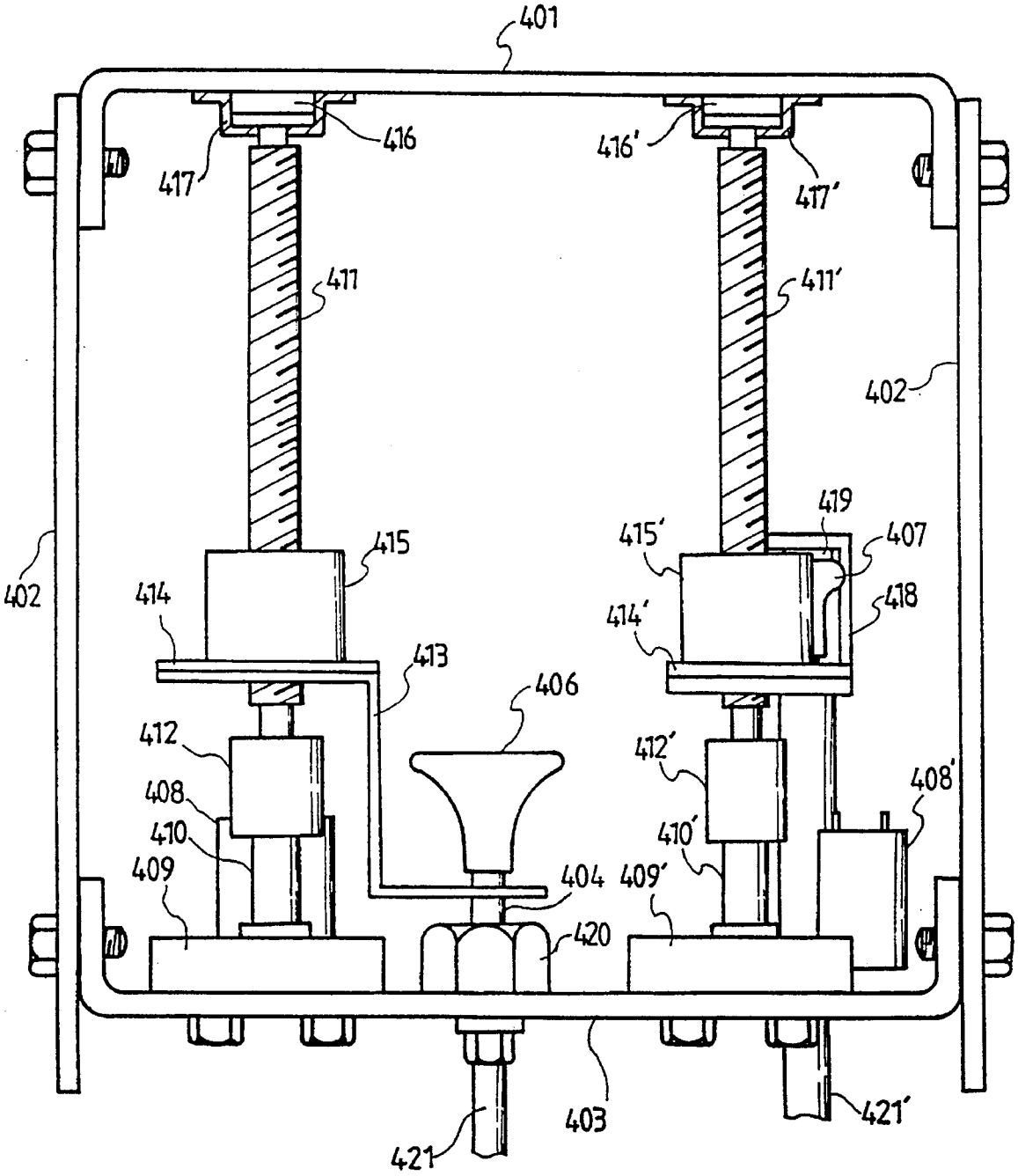
FIG. 14 is a partially-sectioned front view illustrating the acceleration and stop manipulating unit shown in FIG. 13.

In FIGS. 13 and 14, the reference numeral 401 denotes a top plate, 402 side plates, 403 a bottom plate, 403*a* and 403*b* elongated slots, 404 a stop cable, 404*a* a male threaded portion, 405 an acceleration cable, 405*a* a ball receiving groove, 406 the stop knob, 407 the acceleration knob, 407*a* a ball case, 408 and 408' geared motors, 409 and 409' gear boxes, 410 and 410' gear shafts, 411 and 411' ball screws, 412 and 412' universal joints, 413 a stop bracket, 413*a* and 422*a* first elongated slots, 413*b*, 418*b* and 422*b* small slots, 413*c* and 418*c* second elongated slots, 414 and 414' assistant brackets, 414*a* and 414*a'* circular holes, 415 and 415' ball nuts, 416 and 416' bearings, 417 and 417' bearing cases, 418 an acceleration bracket, 419 a push switch, 420 and 420' clamping nuts, 421 and 421' cases, and 422 a support bracket.

As shown in FIGS. 13 and 14, the acceleration and stop manipulating unit 107 is constructed to pull and push the stop knob and the acceleration knob in response to a control signal from the control unit 103 or in response to a manual manipulation of the operator and thereby to achieve starting and stopping of the engine of vibration roller and control of the engine RPM. The acceleration and stop manipulating unit 107 includes the top plate 401 and the bottom plate 403. The bottom plate 403 which has a U shape is mounted to a predetermined portion of an engine driving unit of the vibration roller. The bottom plate 403 is provided at its middle portion with a pair of elongated slots 403*a* and 403*b* each shaped into an elongated slot. The top plate 401 which has an inverted-U shape is connected to the bottom plate 403 by a pair of side plates 402. The top plate 401 is provided at its side portions with slots.

Each of the side plates 402 is mounted to both each corresponding side of the top plate 401 and each corresponding side of the bottom plate 403 by means of screws. Each side plate 402 has a pentagonal construction having a wide upper end and a narrow lower end so as to prevent it from interfering with a switch manipulation panel (not shown) and to make its assembling easy.

Extending through the elongated slot 403*a* of the bottom plate 403 is the stop cable 404 which is surrounded by the case 421. The stop cable 404 has an upper end having the male threaded portion 404*a*. The stop cable 404 serves to switch on/off a start switch (not shown), thereby starting and stopping the engine. Extending through the elongated slot 403*b* of the bottom plate 403 is the acceleration cable 405 which is surrounded by the case 421'. The acceleration cable 405 has an upper end having the ball receiving groove 405*a* having a predetermined depth. The acceleration cable 405 serves to control the fuel injection amount of a throttle valve equipped in the engine and thereby control the RPM of the engine.

The stop knob 406 is threadedly coupled to the upper end of the stop cable 404 so that it pulls or pushes the stop cable 404 by an external force applied thereto, thereby causing the stop cable 404 to move upwards and downwards. Beneath the stop knob 406, the clamping nut 420 having a hollow bolt integral therewith is coupled to the case 421.

Coupled to the upper end of the acceleration cable 405 is the acceleration knob 407 which has at its lower end the ball case 407*a* having a ball. At the coupled state of the acceleration knob 407, the ball of the ball case 407*a* engages in the ball receiving groove 405*a* of acceleration cable 405. Accordingly, when the acceleration knob 407 is pulled or pressed by an external force applied thereto, it forces the acceleration cable 405 to move upwards or downwards, thereby enabling the engine RPM to be controlled on the basis of the speed of the acceleration knob being moved. Beneath the acceleration knob 407, the clamping nut 420' having a hollow bolt integral therewith is coupled to the case 421'.

In this case, driving of the acceleration knob 407 is carried out under a condition that the push switch 419 mounted to the upper portion of the acceleration knob 407 is at its pressed state.

Both the stop knob 406 and the acceleration knob 407 are vertically moved by a drive force from the geared motor 408 which rotates normally or reversely in accordance with the control signal from the control unit 103. Other constructions and various operations of the acceleration and stop manipulating unit 107 will be described in conjunction with starting and stopping of the engine and control of the engine RPM, respectively.

First, the construction for achieving the starting and stopping of the engine will be described. For this construction, the acceleration and stop manipulating unit 107 includes the geared motor 408. The geared motor 408 transmits its drive force to the gear box 409 via a motor gear mounted on a shaft of the motor 408 and engaged with an input gear of the gear box 409. The gear box 408 serves to reduce the rotation speed.

Coupled to the gear box 409 is the gear shaft 410 which extends upwards from the gear box 409. The gear shaft 410 receiving the drive force from the gear box 409 transmits the transmitted drive force to the ball screw 411 which is coupled to the gear shaft 410 at a predetermined angle. Disposed at a joint between the gear shaft 410 and the ball screw 411 is the universal joint 412 which pivots through an angle of 360°. The universal joint 412 provides a coupling between the gear shaft 410 and the ball screw 411 at any varied angle between the gear shaft 410 and the ball screw 411 so as to achieve a well power transmission.

The acceleration and stop manipulating unit 107 also includes the stop bracket 413 having an upper portion provided with the first elongated slot 413*a* and a lower portion provided with the second elongated slot 413*c*. The stop bracket 413 is also provided at its upper portion with a pair of small slots 413*b* respectively disposed in both sides of the first elongated slot 413.

The lower portion of stop bracket 413 is clamped between the stop knob 406 and the clamping nut 420. The second elongated slot 413 is opened at its one end so that the stop cable 404 can be inserted into the second elongated slot 413*c* at the opened end. The stop cable 404 can be coupled to the stop bracket 413 by fastening the stop knob 406 under a condition that the stop cable 404 has been received in the second elongated slot 413*c* of stop bracket 413. By loosening the stop knob 406, the stop cable 404 can be separated from the stop bracket 413.

On the upper portion of the stop bracket 413, the assistant bracket 414 is mounted by means of screws (not shown). The assistant bracket 414 has a plurality of circular holes 414*a* disposed at positions respectively corresponding to the first elongated slot 413*a* and small slots 413*b* of the stop bracket 413. The ball nut 415 is mounted to the assistant bracket 414 by means of screws respectively received in selected ones of the circular holes 414*a*.

As the ball screw 411 rotates, the ball nut 415 is vertically moved along the ball screw 411. This vertical movement of the ball nut 415 forces the stop bracket 413 to move vertically, thereby causing the stop knob clamped to the stop bracket 413 to move vertically.

The stop bracket 413 has the construction having a clutch function for selectively carrying out one of the stop operation in the manual mode and the stop operation in the automatic mode. This clutch operation of the stop bracket 413 is achieved by coupling the stop cable 404 to the stop bracket 413 or separating the stop cable 404 from the stop bracket 413 by utilizing lateral spaces of the first and second elongated slots 413*a* and 413*c* and small slots 413*b*. For the stop operation in the automatic mode, the operator moves the stop bracket 413 in one direction such that the upper portion of the stop cable 404 is inserted into the second elongated slot 413*c*. Under this condition, the stop knob 406 is fastened to the upper end of the stop cable 404 and thereby clamped to the stop bracket 413 so that it can move vertically together with the stop bracket 413. For the stop operation in the manual mode, the stop knob 406 is loosened from the stop cable 404. Thereafter, the stop bracket 413 is moved in a direction reverse to the coupling direction such that the stop cable 404 is separated from the second elongated slot 413*c*. Under this condition, the vertical movement of the stop cable 404 is carried out irrespective of the movement of the stop bracket 413.

Mounted on the upper end of the ball screw 411 is the bearing 416 serving to prevent a friction from occurring at the upper end of ball screw 411 during the rotation of the ball screw 411. The bearing 416 is supported in the bearing case 417 mounted to the top plate 401.

In association with the acceleration knob 407, a construction similar to the above-mentioned construction is employed. That is, the acceleration and stop manipulating unit 107 also includes the support bracket 422 having an upper portion provided with the first elongated slot 422*a* and a lower portion provided with one small slot 422*b*. The support bracket 422 is also provided at its upper portion with a pair of small slots 422*b*. In the first elongated slot 422*a*, the ball screw 411' is fitted. On the upper portion of the support bracket 422, the assistant bracket 414' is mounted. The assistant bracket 414' has a plurality of holes 414*a'* disposed at positions respectively corresponding to the first elongated slot 422*a* and small slots 422*b* of the support bracket 422.

Mounted to the lower portion of support bracket 422 is the acceleration bracket 418 overlapping with the lower portion of support bracket 422 and having a 90°-inverted U shape. The acceleration bracket 418 is provided at the end of its lower portion with the small slot 422*b* corresponding to the small slot 422*b* formed at the lower portion of support bracket 422. The mounting of the acceleration bracket 418 to the support bracket 422 is achieved by fitting a screw in the small slots 422*b*. Under this condition, the acceleration bracket 418 can be pivotally moved with respect to the support bracket 422. The acceleration bracket 418 also has the second elongated hole 418*c* formed at a predetermined position on the lower portion thereof and fitted around the ball case 407*a* of the acceleration knob 407 so as to vertically move the acceleration knob 407. The second elongated hole 418*c* is opened at its one end. Accordingly, the ball case 407 and the acceleration knob 407 can be easily coupled to and separated from the acceleration bracket 418 even in the narrow space by virtue of the pivotal movement of the acceleration bracket 418 with respect to the support bracket 422 and the construction of the opened second elongated hole 418*c*.

At the coupled state of the acceleration knob 407 to the acceleration bracket 418, the upper portion of the acceleration bracket 418 is always in contact with the push switch 419 provided at the upper end of the acceleration knob 407 while pressing the push switch 419. As the ball screw 411' rotates, the acceleration bracket 418 is vertically moved, thereby causing the acceleration cable 405 coupled to the acceleration knob 407 to move.

The reason why the push switch 419 is maintained at its pressed state by virtue of the 90°-inverted U shape of the acceleration bracket 418 is because the vertical movement of the acceleration knob 407 for vertically moving the acceleration cable 405 is allowed only at the pressed state of the push switch 419.

By such a construction, when the acceleration bracket 418 moves upwards by the drive force of the geared motor 408, the acceleration knob 407 is pulled, thereby causing the acceleration cable 405 to be lifted. In this state, the engine RPM is accelerated. On the contrary, when the acceleration bracket 418 moves downward, the clamping nut 420' coupled to the upper end of the acceleration cable 405 is pressed down by the acceleration bracket 418, thereby causing the acceleration cable 405 to move downwards. In this state, the engine RPM is decreased.

The adjustment of the engine RPM by the acceleration knob 407 is carried out by adjusting the RPM of the geared motor 408' as compared to the conventional method in which the adjustment of the engine RPM is carried out only on the basis of the speed of the acceleration knob being pulled.

Figure 15:
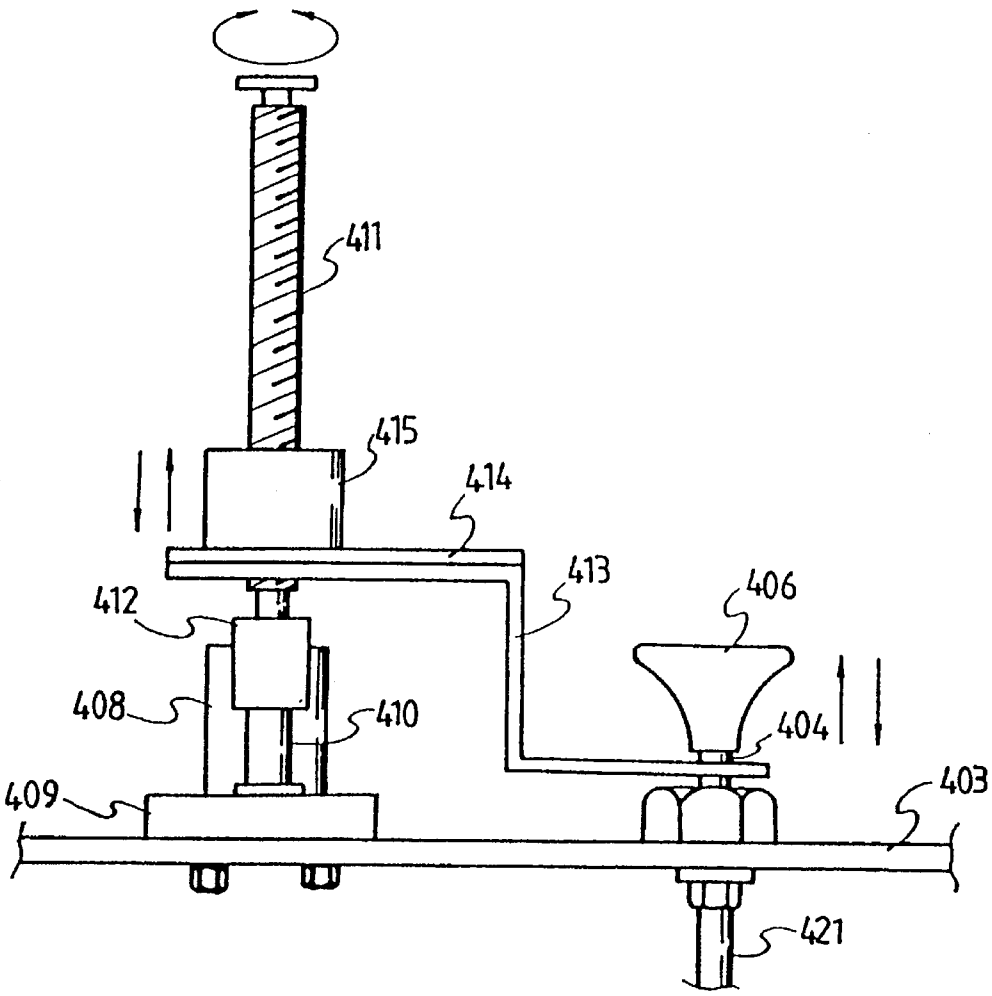
FIG. 15 is a partially-sectioned front view illustrating a condition of the acceleration and stop manipulating unit shown in FIG. 13 in an engine stop manipulating mode.

Now, the operations of the acceleration and stop manipulating unit 107 will be described in more detail in conjunction with FIGS. 15 and 16.

First, the description will be made in conjunction with FIG. 15. As shown in FIG. 15, as the geared motor 408 is driven in a normal direction in response to the control signal from the control unit 103, it transmits its drive force to the gear box 409.

The drive force from the gear box 409 is then transmitted in the form of a normal rotation force to the ball screw 411 via the gear shaft 410 and the universal joint 412, thereby causing the ball nut 415 to move upwards. By the upward movement of the ball nut 415, the assistant bracket 414 fixed to the ball nut 415 and the stop bracket 413 moves upwards, thereby causing the stop knob 406 to be pulled. Accordingly, the engine is started.

On the contrary, when the geared motor 408 is reversely driven, the ball screw 411 rotates reversely, thereby causing the ball nut 415 and the stop bracket 413 to move downwards. The stop bracket 413 moving downwards pushes down the stop cable 404 supported by the clamping nut 420, thereby causing the stop cable 404 to move downwards. Accordingly, the engine is stopped.

Figure 16:
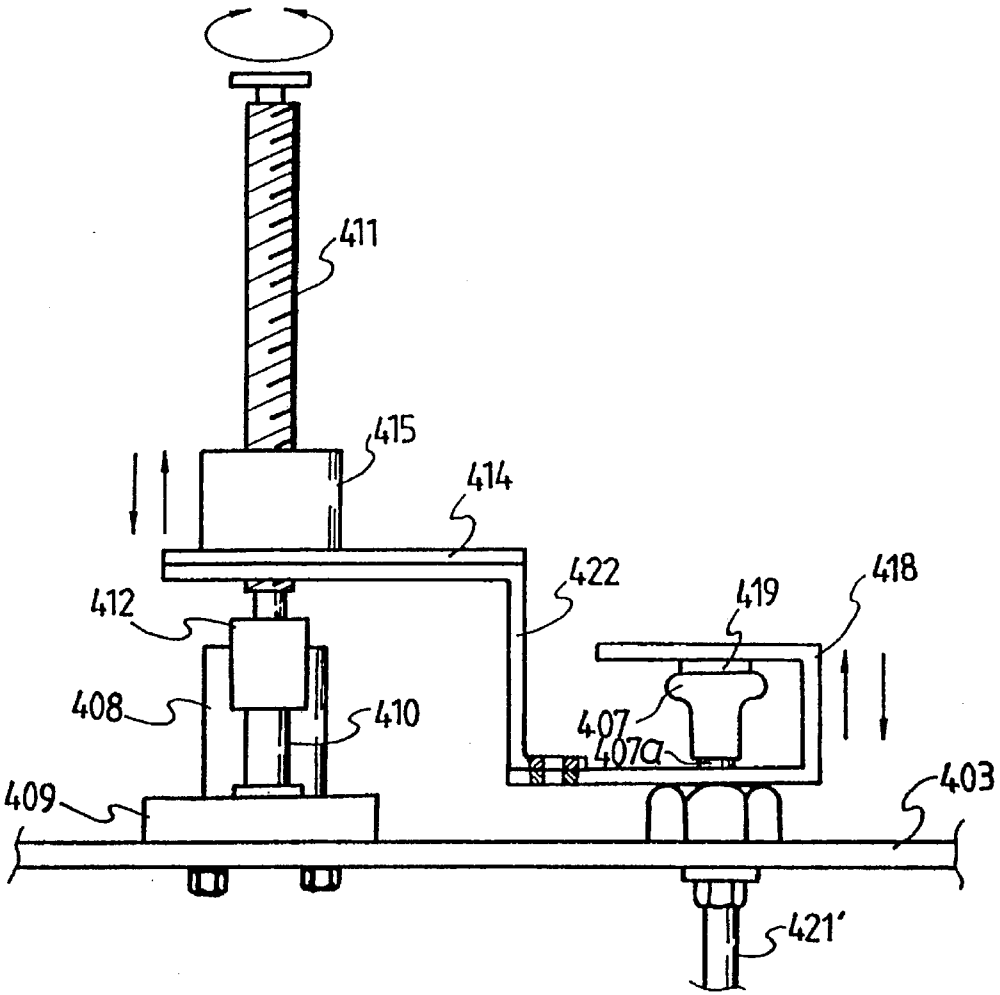
FIG. 16 is a partially-sectioned front view illustrating a condition of the acceleration and stop manipulating unit shown in FIG. 13 in an engine acceleration/reduction manipulating mode.

The adjustment of the engine RPM by the acceleration knob 407 is carried out in a manner similar to the above-mentioned manner, as shown in FIG. 16. That is, as the ball nut 415' moves upwards by the normal rotation of the ball screw 411', the acceleration bracket 418 pulls up the acceleration knob 407. As a result, the acceleration cable 405 is lifted correspondingly to the number of rotations of the geared motor, thereby accelerating the engine RPM.

When the geared motor 408' is reversely driven, the ball screw the ball nut 415' and the acceleration bracket 418 move downwards. The acceleration bracket 418 moving downwards pushes down the acceleration cable 418 supported by the clamping nut 420', thereby causing the acceleration cable 418 to move downwards. Accordingly, the engine RPM is decreased.

Thus, the engine RPM is controlled by controlling the speed of the acceleration knob 407 being lifted or lowered on the basis of the number of rotations of the geared motor 408' and thereby controlling the fuel injection amount of the throttle valve.

Although the acceleration bracket 418 has been described as having the 90°-inverted U shape because it is applied to the embodiment wherein it always pushes the push switch 419 for the vertical movement of the acceleration knob 407, it may have other construction depending on the driving mechanism of the vibration roller. The acceleration bracket 418 may also have various shapes in so far as it has the function of holding the acceleration knob 407.

On the other hand, where the stop knob 406 is to be manually manipulated, the stop bracket 406 is moved such that the stop cable 404 is separated from the elongated slots 413*c*. Under this condition, the stop knob 406 can be manually pulled or pushed. Where the acceleration knob 406 is to be manually manipulated, the acceleration bracket 406 is moved such that the ball case 407*a* of the acceleration knob 407 is separated from the elongated slot 418*c*. Under this condition, the acceleration knob 407 can be manually pulled or pushed.

As apparent from the above description, the present invention provides an apparatus for and a method of remote controlling an operation of a vibration roller, capable of achieving the operation of vibration roller under a condition that no operator have a ride in the vibration roller. Accordingly, it is possible to eliminate the problem of a damage of operator encountered in the conventional case involving a manual manipulation for the vibration roller. In accordance with the present invention, it is also possible to simplify the work condition and achieve improvements in efficiency and in economy.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for manually or remotely controlling a vibration roller having an engine, comprising:

first means for enabling forward and rearward running operation of the vibration roller, the first means including adjusting means for determining the forward and rearward running operations of the vibration roller, the adjusting means including a manually movable lever, a rotatably mounted member, first power generating means for causing the member to be rotated by remote control, and power transmitting means for receiving a turning force from the first power generating means and rotating the adjusting means when the vibration roller is being operated under remote control, and for isolating the adjusting means from the member when the vibration roller is being operated under manual control;

second means for adjusting a direction of travel of the vibration roller, the second means including a manually operable handle, and a second power generating means for causing the handle to be rotated by remote control;

third means for stopping the engine of the vibration roller, the third means including an engine stopping cable, a manually operable stopping knob connected to the engine stopping cable, a first screw, a third power generating means for causing the first screw to be rotated by remote control, a first nut engaged with the first screw, such that the first nut moves along the first screw when the first screw rotates, and a first bracket connected to the first nut, the first bracket moving the stopping knob when the vibration roller is being operated by remote control; and fourth means for accelerating and decelerating the engine, the fourth means including an engine acceleration/deceleration cable, a manually operable acceleration control knob connected to the acceleration/deceleration cable, a second screw, a fourth power generating means for causing the second screw to be rotated by remote control, a second nut engaged with the second screw, such that the second nut moves along the second screw when the second screw rotates, and a second bracket coupled to the second nut, the second bracket moving the acceleration control knob when the vibration roller is being operated by remote control.

2. An apparatus in accordance with claim 1, wherein the member comprises a first spline shaft, and wherein the first power generating means comprises a first motor which is capable of being rotated clockwise or counterclockwise, and a gear train connecting the first motor to the first spline shaft.

3. An apparatus in accordance with claim 2, wherein the adjusting means comprises a second spline shaft which is mounted coaxially with respect to the first spline shaft, the lever being connected to the second spline shaft.

4. An apparatus in accordance with claim 3, wherein the power transmitting means comprises:

a spline key which is movable between a connected position wherein the first and second spline shafts are connected and a disconnected position wherein the first and second spline shafts are not connected;

another handle; and means for connecting the another handle to the spline key.

5. An apparatus in accordance with claim 1, wherein the handle of the second means is connected to a rotably mounted shaft, and wherein the second power generating means comprises a second motor which is capable of being rotated clockwise or counterclockwise, and a gear train connecting the second motor to the shaft on which the handle is mounted.

6. An apparatus in accordance with claim 1, wherein the third power generating means comprises a third motor which is capable of being rotated clockwise or counterclockwise; and means for connecting the third motor to the first screw, the means for connecting the third motor to the first screw including a gear train.

7. An apparatus in accordance with claim 1, wherein the fourth power generating means comprises a fourth motor capable of being rotated clockwise or counterclockwise; and means for connecting the fourth motor to the second screw, the means for connecting the fourth motor to the second screw including a gear train.

8. An apparatus in accordance with claim 1, wherein the second bracket is a 90°-inverted U shape to press the acceleration control knob when the speed of the vibration roller is varied.

9. An apparatus for remotely controlling a vibration roller having a plurality of functional units, the functional units of the vibration roller including a first functional unit having a manually rotatable control member to control a first function of the vibration roller and a second functional unit having a control knob that is manually movable along a path to control a second function of the vibration roller, said apparatus comprising:

wireless transmitting means for transmitting operation control data;

wireless receiving means in the vibration roller for receiving the control data;

first means in the vibration roller for remotely controlling the first functional unit on the basis of received control data if an operator is not present to manually rotate the control member, the control member being rotated by the first means; and second means in the vibration roller for remotely controlling the second functional unit on the basis of received control data if an operator is not present to manually move the control knob, the control knob being moved by the second means.

10. The apparatus of claim 9, wherein the first functional unit comprises a forward/rearward running manipulating unit which includes a shaft and a leaver mounted on the shaft, the leaver being the manually rotatable control member, and wherein the first means comprises a motor and means for coupling the motor to the shaft.

11. The apparatus of claim 10, wherein the means for coupling comprises a clutch.

12. The apparatus of claim 9, wherein the first functional unit comprises a steering unit which includes a shaft and a handle mounted on the shaft, the handle being the manually rotatable control member, and wherein the first means comprises a motor and a gear train linking the motor to the shaft.

13. The apparatus of claim 9, wherein the second functional unit comprises an acceleration manipulating unit having a cable and an acceleration knob connected to the cable, the acceleration knob being the manually movable control knob, and wherein the second means comprises a motor, a screw, means for coupling the motor to the screw, a nut mounted on the screw, and a bracket connected to the nut, the bracket being configured to engage the acceleration knob.

14. The apparatus of claim 9, wherein the wireless transmitting means comprises:

a key pad functioning as a user command data interface;

a signal generator for generating a signal frequency corresponding to a key input from the key pad; and an infrared light emitting circuit for converting an output from the signal generator into an infrared light signal.

15. The apparatus of claim 9, wherein the wireless transmitting means comprises:

a keypad functioning as a user data command interface;

a dual-tone multifrequency generating circuit for generating a dual-tone multifrequency signal corresponding to a key input from the key pad; and a modulating and transmitting circuit for modulating a output signal from the dual-tone multifrequency generating circuit and outputting a corresponding wireless signal.

* * * * *